US007730884B2

(12) United States Patent
Sato et al.

(10) Patent No.: US 7,730,884 B2
(45) Date of Patent: Jun. 8, 2010

(54) DIVING APPARATUS

(76) Inventors: Tomoyuki Sato, Unit 37, 36 Stafford Avenue, Main Beach, QLD 4217 (AU); Takeshi Kiyama, The Blk 11, No. 12-04, Tanjong Rhu Road, Singapore (SG) 436896

( * ) Notice: Subject to any disclaimer, the term of this patent is extended or adjusted under 35 U.S.C. 154(b) by 1070 days.

(21) Appl. No.: 10/528,591

(22) PCT Filed: Sep. 19, 2003

(86) PCT No.: PCT/AU03/01228

§ 371 (c)(1),
(2), (4) Date: Nov. 22, 2005

(87) PCT Pub. No.: WO2004/026680

PCT Pub. Date: Apr. 1, 2004

(65) Prior Publication Data

US 2006/0118109 A1 Jun. 8, 2006

Related U.S. Application Data

(60) Provisional application No. 60/412,031, filed on Sep. 19, 2002, provisional application No. 60/419,242, filed on Oct. 17, 2002, provisional application No. 60/492,668, filed on Aug. 5, 2003.

(51) Int. Cl.
*B63C 11/02* (2006.01)

(52) U.S. Cl. ..... 128/201.27

(58) Field of Classification Search ..... 128/207.15, 128/200.24, 201.12, 201.22, 201.24, 201.23, 128/201.27; 405/186, 187, 193; 2/413, 421
See application file for complete search history.

(56) References Cited

U.S. PATENT DOCUMENTS

| | | | | | |
|---|---|---|---|---|---|
| 1,930,399 | A | * | 10/1933 | Stelzner | 128/201.23 |
| 3,351,089 | A | * | 11/1967 | Garrahan | 137/599.04 |
| 3,680,556 | A | * | 8/1972 | Morgan | 128/201.15 |
| 3,835,852 | A | * | 9/1974 | Anderson | 128/202.27 |
| 3,845,768 | A | * | 11/1974 | Garrahan | 128/206.24 |
| 3,958,275 | A | * | 5/1976 | Morgan et al. | 2/421 |

(Continued)

FOREIGN PATENT DOCUMENTS

EP 0 853 962 A2 7/1998

(Continued)

*Primary Examiner*—Steven O Douglas
(74) *Attorney, Agent, or Firm*—McDermott Will & Emery, LLP

(57) ABSTRACT

A diving apparatus includes a support structure (18) that is engageable with a diver's head, the support structure (18) defining a lens opening (262) and an equalization opening (104). A lens (26) is mounted on the support structure (18) to close the lens opening (262) so that the support structure (18) and the lens (26) define a breathing space (30) from which the diver can be supplied with air. A sealing arrangement is positioned on the support structure (18) sealingly to engage the diver's face so that the breathing space (30) is substantially airtight. An equalization assembly (106) is mounted on the support structure (18) to close the equalization opening (104). The equalization assembly (106) includes an access means to permit the diver to gain access to his or her nose so that the diver can carry out an equalization procedure. A gas supply arrangement is in fluid communication with the breathing space (30).

11 Claims, 42 Drawing Sheets

U.S. PATENT DOCUMENTS

| | | | | | |
|---|---|---|---|---|---|
| 4,667,667 | A | * | 5/1987 | Schnoor et al. | 128/201.18 |
| 5,040,528 | A | * | 8/1991 | O'Neill | 128/201.27 |
| 5,079,775 | A | * | 1/1992 | Kaburaki | 128/200.29 |
| 5,219,368 | A | * | 6/1993 | Page | 2/413 |
| 5,522,091 | A | * | 6/1996 | Rudolf | 2/6.2 |
| 5,572,989 | A | | 11/1996 | Lutz et al. | |
| 5,575,277 | A | | 11/1996 | Lutz et al. | |
| 5,607,258 | A | * | 3/1997 | Eungard | 405/186 |
| 5,860,168 | A | * | 1/1999 | Winefordner et al. | 2/428 |
| 5,906,200 | A | * | 5/1999 | Kaburaki | 128/201.27 |
| 5,979,441 | A | | 11/1999 | Hsieh | |
| 6,070,577 | A | * | 6/2000 | Troup | 128/205.22 |
| 6,155,253 | A | * | 12/2000 | Gamberini | 128/201.18 |
| 6,302,103 | B1 | * | 10/2001 | Resnick | 128/201.23 |
| 6,666,210 | B2 | * | 12/2003 | Semeia | 128/207.13 |
| 7,406,964 | B2 | * | 8/2008 | Diaz | 128/205.22 |

FOREIGN PATENT DOCUMENTS

| | | | |
|---|---|---|---|
| JP | 162783 | | 3/1941 |
| JP | 04215591 | A | 8/1992 |
| WO | WO 98/55163 | A2 | 10/1998 |
| WO | WO 02/081302 | A1 | 10/2002 |

* cited by examiner

DIVING APPARATUS

This application claims priority from PCT Application No. PCT/AU2003/001228, file 19 Sep. 2003 (incorporated by Reference herein), which claims priority from U.S. Application No. 60/412,031 (file 19 Sep. 2002); U.S. Application No. 60/419,242 (filed 17 Oct. 2002); and, Application No. 60/492,668, (filed 5 Aug. 2003) (incorporated by reference herein).

FIELD OF THE INVENTION

This invention relates to a diving apparatus. More particularly, this invention relates to a diving apparatus that is particularly suited to recreational diving and the leisure industry. However, Applicant submits that the diving apparatus is not limited to such use and incorporates features that are useful in the commercial diving industry as well.

BACKGROUND TO THE INVENTION

The leisure diving industry has experienced substantial growth. The apparatus used in that industry are specifically designed so that divers do not need to undergo certification before being able to dive.

In particular, such apparatus usually include a one-piece moulding that rests on a diver's shoulders. The principle behind these apparatus is that they trap air in a breathing zone about a diver's head. Air is then pumped into this zone from the surface to permit a diver to breathe. This is an ancient concept and has been used for many years to supply breathable air to a diver.

The breathing zone defined by these apparatus is relatively large and therefore generates a substantial buoyant force. It follows that the apparatus must be of sufficient weight to ensure that the apparatus remains on a diver's shoulders. This has resulted in presently used apparatus weighing as much as 35 Kg. This weight is exerted on the diver's shoulders. It will be appreciated that a combination of the diver and such an apparatus has a high centre of gravity.

These characteristics have led to a number of disadvantages.

The primary disadvantage is that of safety. The high centre of gravity results in a situation where a diver can easily tip over if he or she loses their balance. This can result in the air in the breathing zone being replaced by water, adding even more weight to the apparatus. This extra weight can quickly drag a diver over, resulting in drowning and injury. This tipping over can also occur if the hooker line becomes snagged on an underwater object. It follows that a diver must always be sure to remain erect. This is inconvenient and limits the maneuverability of the diver.

A further problem associated with the weight of the apparatus is that it is not possible for a diver to get to the surface in case of an emergency. This is one of the reasons why such apparatus have not achieved accreditation with the various dive organizations.

The weight of the apparatus often makes it difficult for less robust divers to walk about safely. It follows that they often require a stationary bar to grasp in order to stabilize themselves.

As a result of the weight of the apparatus, it is extremely difficult to manipulate them out of water. In order to place one of them on the shoulders of a diver, it is often necessary to lower the apparatus on to the shoulders using a block and pulley system with a rope or cable attached to the apparatus.

If an instructor's hands are wet, the rope or cable could slip, resulting in injury to the diver.

Another disadvantage is that associated with the volume of the breathing zone. The volume is such that it is not feasible to provide the apparatus with an independent back up air supply, such an air supply would require a tank that would be too big to form part of the apparatus. Thus, the apparatus is not supplied with a back up system. This is another reason why the apparatus have not achieved accreditation with the various dive organizations.

The apparatus do not include a regulator and a constant flow of air is supplied to the breathing volume. It follows that exhaust air mixes with fresh air and both often escape. As is known in the industry, it is relatively expensive to pump air to such an apparatus. It follows that such wastage is undesirable. This is exacerbated by the fact that the apparatus requires a high volume output compressor in order to accommodate different depths.

Commercial-type diving rigs are not considered for the leisure and recreational market. The primary reason for this is comfort and the fact that such rigs are not photo-friendly. These rigs fasten rather tightly about a diver's neck. This can lead to substantial discomfort. These rigs include a face piece which engages a diver's mouth and nose. This renders the diver unrecognisable and so reduces the opportunity for photography.

A problem associated with masks that trap a breathing space about a diver's face is that it becomes difficult to equalize, which is a procedure achieved by pinching the nostrils closed and "popping" the eardrums. Clearly, with the rational apparatus described above, this is not a disadvantage, since the diver can simply manoeuvre his or her hand into the helmet to pinch the nostrils closed. With presently available commercial rigs, the diver must allow water to enter the mask with his or her hand and then expel the water. It will be appreciated that this could be too traumatic or difficult for recreational divers who would generally use the recreation apparatus described above.

Applicant has identified the need for a diving apparatus that can address the disadvantages associated with the presently used recreational rig, while providing an easy means for equalization.

SUMMARY OF THE INVENTION

According to a first aspect of the invention, there is provided a diving apparatus which includes

- a support structure that is engageable with a diver's head;
- a lens that is mounted on the support structure, the support structure and the lens defining a breathing space from which the diver can be supplied with air;
- a sealing arrangement that is positioned on the support structure sealingly to engage the diver's face so that the breathing space is substantially airtight;
- an equalization assembly that is mounted on the support structure, the equalization assembly including an access means to permit the diver to gain access to his or her nose so that the diver can carry out an equalization procedure; and
- a gas supply arrangement that is in fluid communication with the breathing space to supply the breathing space with gas.

The access means may include a nose-engaging member that is displaceable with respect to the support structure between an inoperative position in which the nose-engaging member is free of a diver's nose and an operative position in which the nose-engaging member can be used to block the diver's nostrils so that the diver can perform an equalization procedure.

The equalization assembly may include a pocket-shaped, flexible membrane that has an open end that is fast with the support structure at the equalization opening and a dosed end that defines the nose-engaging member, the membrane being dimensioned to accommodate the ingress of at least a diver's thumb and forefinger into the breathing space.

The equalization assembly may include a base structure that is sealingly engageable with an edge portion of the support structure defining the equalization opening and an extendible portion interposed between the nose-engaging member and the base structure, the extendible portion defining a volume in which at least two digits of the diver can be received so that the extendible portion can be urged toward the diver's nose into the operative position and retracted from the diver's nose into the inoperative position.

The nose-engaging member may include a pair of sockets each socket may be shaped to receive a digit, with the sockets being spaced so that the diver's nose can be received between the sockets when the nose-engaging member is displaced into the operative position. A nosepiece may be mounted on the sockets, the nosepiece being shaped so that, as the nose-engaging member is urged into contact with the diver's nose, the nosepiece serves to block the diver's nostrils.

In a further embodiment, a closure assembly may be mounted on the base member to dose an equalization opening defined in the support structure. The closure assembly may be displaceable between an open and a closed condition so that when a diver urges his or her hand against the closure assembly, the closure assembly is displaced into its open condition to permit ingress of at least the diver's thumb and forefinger. The closure assembly may include a fastener that is operable to retain the closure assembly in its dosed condition.

The diving apparatus may include a regulator that is mounted an the support structure to be in fluid communication with the breathing space.

The diving apparatus may include a connecting valve assembly, the connecting valve assembly having an inlet and an outlet, a primary air source being connectable to the inlet. A primary inlet of a safety valve assembly may be connected to the outlet of the connecting valve assembly. The safety valve assembly may also have a secondary inlet and a primary outlet, the primary outlet being connected to the regulator. A back-up, self-contained air supply having an outlet valve assembly may be connected to the secondary inlet of the safety valve assembly. A control means may be arranged on the safety valve assembly to permit the safety valve assembly to direct air flow from the back up air supply instead of the primary air source, when necessary.

The connecting valve assembly may be configured so that the primary air source can be in the form of a hooker pipe that is connectable to the inlet of the connecting valve assembly.

The safety valve assembly may be in the form of a manually operable on/off valve assembly having a lever or the like and configured so that operation of the lever can simultaneously shut off the primary inlet and open the secondary inlet and vice versa. Instead, the safety valve assembly may be in the form of a shuttle valve assembly, as described in Applicant's International Application no. PCT/JP010/07362 filed on 27 Aug. 2001. As set out in that application, the shuttle valve assembly may be configured so that, when the pressure of air supplied by the hooker pipe drops below a predetermined amount, the shuttle valve assembly operates to shut off the primary inlet and open the secondary inlet. Conversely, when the pressure of the air supplied by the hooker pipe remains above that predetermined amount, the shuttle valve is kept in a condition in which the primary inlet is open and the secondary inlet is closed.

The diving apparatus may include a shoulder harness. The support structure may be connected to the shoulder harness with a flexible collar member that is interposed between the shoulder harness and the helmet. The back up air supply may be in the form of a breathing tank that is mounted on the shoulder harness.

The flexible collar member may include an inflatable bladder. An inflating mechanism may be mounted on the inflatable bladder to permit a diver to inflate the bladder and thus adjust a fit of the collar member. The safety valve assembly may include a secondary outlet that is connected to the inflating mechanism with a suitable conduit so that air from said air source can be used to inflate the bladder. The inflatable bladder may incorporate a dump valve to permit the air in the inflatable bladder to be expelled.

The shoulder harness may include a rigid, lightweight support member that is moulded to fit over a diver's shoulders. The breathing tank may be mounted on the support member. The breathing tank may be of the type that is significantly smaller than a standard SCUBA tank. In particular, the form of breathing tank envisaged by the Applicant may be in the region of 30 to 40 centimetres long with a diameter of between 5 and 10 centimetres. It will be appreciated that the outlet valve assembly of the breathing tank may be in the form of a regulator.

The safety valve assembly may also be mounted on the support member so that both the breathing tank and the safety valve assembly are conveniently accessible.

The diving apparatus may include a hood and a fastening structure that is positioned over the hood. The hood may be similar to a standard hood of a wet suit. It follows that the hood may be of neoprene. The fastening structure may be engageable with the support structure. A portion of the support structure may carry the sealing arrangement so that, in use, the sealing arrangement is interposed between the diver's face and said portion of the support structure. The fastening structure may be adjustable so that the support structure can be moved towards and away from the divers face.

The support structure may include a base member to which the collar member is attached. An adjustable cover assembly may be mounted on the base member. The cover assembly may be adjustable between an operative position in which it covers the fastening structure and an inoperative position in which it allows access to the fastening structure.

The regulator may be mounted on the base member to be in fluid communication with the breathing space.

The equalization opening may be defined in the base member. The base structure of the equalization assembly may be detachably mounted on the base member so that the equalization assembly can be detached from the base member to provide access to the breathing space, via the equalization opening.

The base structure may be pivotally mounted on the base member to be pivotal between an open position in which the equalization assembly is detached from the base member and a closed position in which the base structure 15 sealingly engaged with the base member to close the equalization opening.

A quick release dipping assembly may be arranged on the base structure and the base member, to permit the base structure to be dipped on to or off the base member.

The lens may be dimensioned so that substantially all of the diver's face is visible through the visor. The sealing arrangement may be in the form of a sealing member that is positioned to engage a periphery of the diver's face.

A pair of air valve assemblies may be positioned on the support structure to engage the diver's ears. The air valve assemblies may thus be configured to inhibit the build up of excessive trapped air pressure while the diver is underwater.

The support structure may incorporate an exhaust valve assembly. This valve assembly may be configured to permit water to be pushed out of the breathing air space without backflow. In order to achieve this, the exhaust valve assembly may include a suitably oriented non-return valve.

The apparatus may include a quick release mechanism that is engaged with the connecting valve assembly. The quick release mechanism may be similar to that described in Applicant's International Patent Application No. PCT/JP01/07363. Thus, the quick release mechanism may be configured so that a diver can release the hooker pipe from the connecting valve assembly quickly in the event of an emergency. The connecting valve assembly may incorporate a closure member that is operable to close the connecting valve assembly when the hooker pipe is released.

Instead of the cover assembly, the support structure may include a cover member of a flexible material. The cover member may be shaped to impart an aesthetic appearance to the cover member, in this embodiment, access openings may be defined in the cover member to permit the diver to gain access to the fastening structure.

Instead of the shoulder harness, the apparatus may include a weighted dive jacket that is worn by the diver. In this case, the quick release mechanism, the safety valve assembly and the back up air supply tank may be mounted on the dive jacket. The helmet may be fast with the jacket.

In a further embodiment, the apparatus may include a neck engaging arrangement that is configured to engage the diver's neck. The support structure may be fast with the neck engaging arrangement.

In the case where the apparatus includes a shoulder harness, the apparatus may also include what is known as a dry suit. The shoulder harness and the helmet may be fast with the dry suit.

According to a second aspect of the invention, there is provided an accessory for a diving apparatus having a support structure and a lens mounted on the support structure such that the lens and the support structure together define a breathing space, the support structure defining an equalization opening in communication with the breathing space for permitting a diver to equalize, the accessory including an access means that is mounted on the support structure to dose the equalization opening, the access means being configured to permit the diver to gain access to the breathing space to carry out the equalization procedure.

The access means may include a base structure that is engageable with an edge portion of the helmet defining the equalization opening and a nose-engaging member that is attached to the base structure to be displaceable away from the base structure into an operative position in which the diver can shut his or her nostrils with the nose-engaging member and towards the base structure into an inoperative position in which the nose-engaging member is clear of the diver's nose.

An extendible portion may be interposed between the base structure and the nose-engaging member to extend and retract as the nose-engaging member is displaced into and out of its operative position respectively.

A nosepiece may be mounted on the nose-engaging member and may be shaped to bear against the diver's nostrils to block the nostrils when the nose-engaging member is displaced into its operative position.

The invention is now described, by way of example, with reference to the accompanying drawings.

DETAILED DESCRIPTION OF THE DRAWINGS

Figure 1:
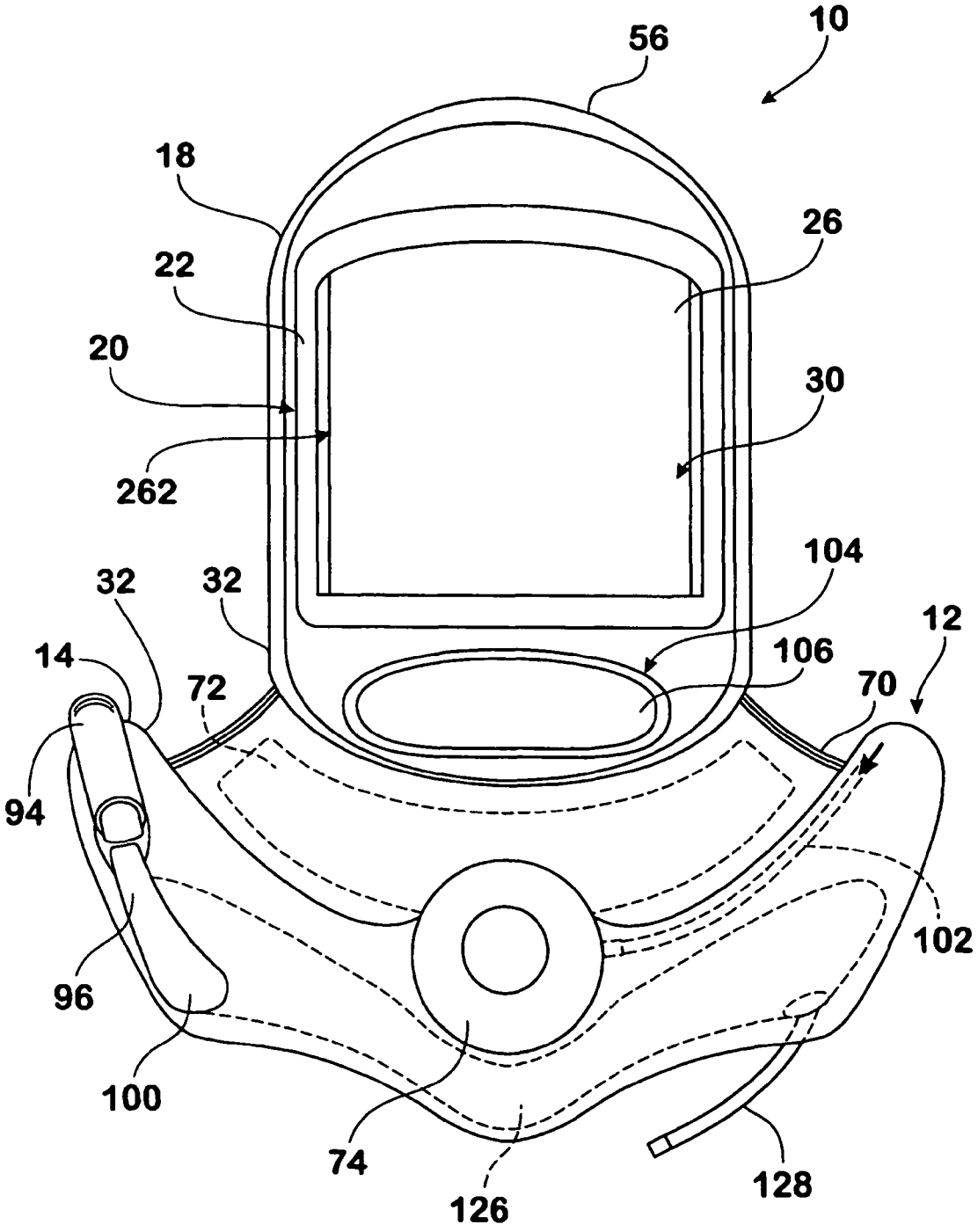
FIG. 1 shows a front view of a fist embodiment of a diving apparatus, in accordance with the invention.
Figure 2:
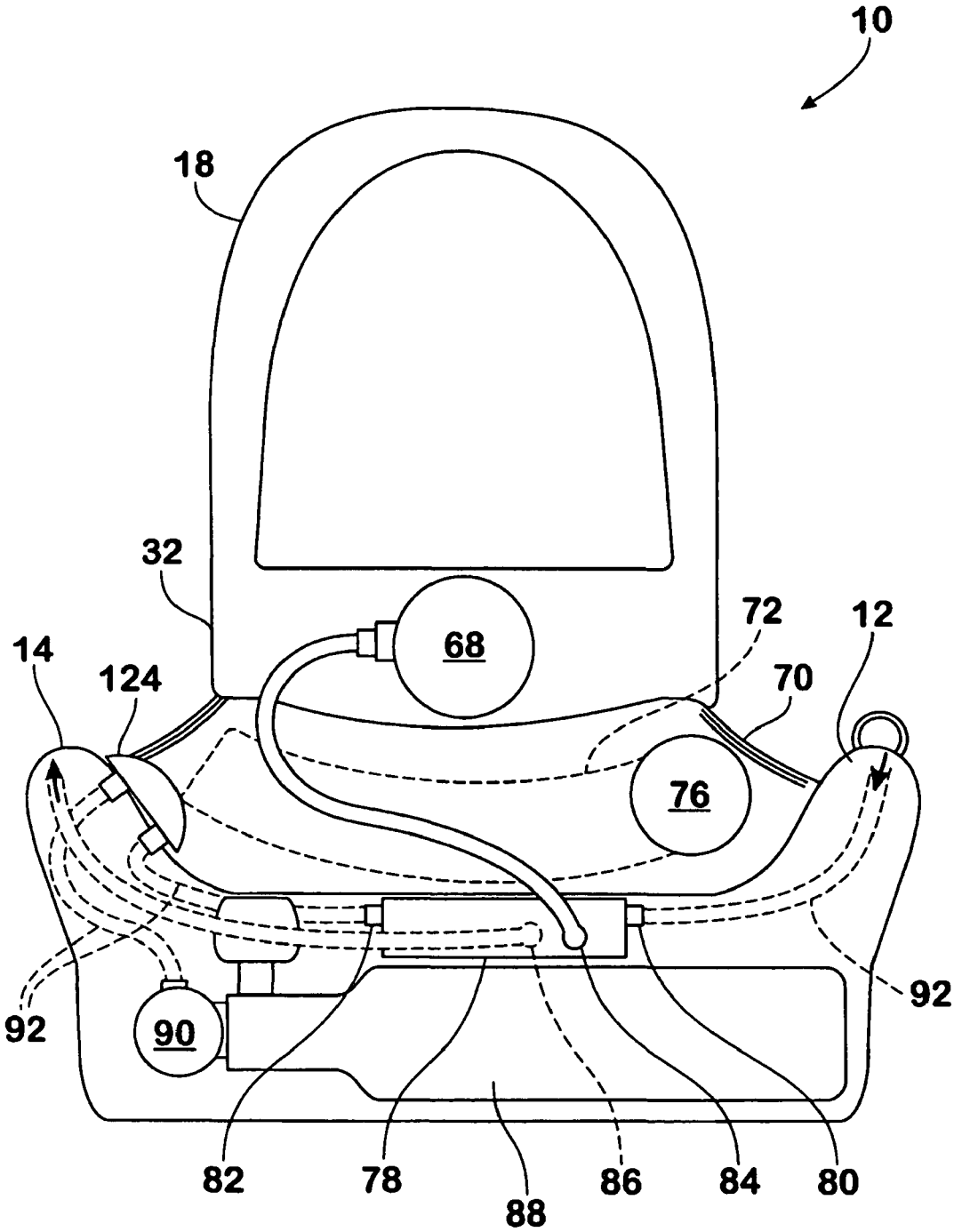
FIG. 2 shows a rear view of the diving apparatus of FIG. 1.

In FIGS. 1, 2, and 5 to 13, reference numeral 10 generally indicates a first embodiment of a diving apparatus, in accordance with the invention.

The diving apparatus 10 includes a shoulder harness 12. The shoulder harness 12 includes a rigid support member 14. The rigid support member 14 is of a moulded plastics material such as polyethylene. The shoulder harness 12 further includes a fastening arrangement, such as straps, to fasten the support member 14 to a diver's shoulders 16.

The diving apparatus 10 includes a support structure in the form of a helmet 18. The helmet 18 can be of fibreglass or a reinforced plastics material. A mask assembly 20 is positioned on the helmet 18. The helmet 18 is shaped to define a rearwardly positioned facial opening 260 that is positioned to frame a diver's face 24. The helmet 18 is also shaped to define a forwardly positioned lens opening 262. The mask assembly 20 includes a lens frame 22 that is mounted on the helmet 18 to frame the lens opening 262. The mask assembly 20 includes a lens 26 that is fast with the lens frame 22. Thus, substantially all of the diver's face 24 is visible through the lens 26. The lens 26 can be of any suitably strong transparent material such as an acrylic material.

The apparatus 10 includes a sealing arrangement in the form of a sealing member 28 of a suitable sealing material such as silicon. The sealing member 28 is positioned on an internal portion 264 of the helmet 28 that defines the facial opening 260. Thus, the sealing member 28 is interposed between a periphery of the diverts face 24 and the internal portion 264 that defines the facial opening 260, in use. The sealing member 28 and lens 26 thus serve to define a breathing air space 30 in which the diver's face 24 is positioned. The sealing member 28 can include an inflatable tube to facilitate adjustment of the sealing member 28.

The helmet 18 includes a rigid base member 32. The mask assembly 20 is mounted on the base member 32.

The helmet 18 includes a neoprene hood 34 that fits over the diver's head 36. The hood 34 includes a neck portion 38. A zipper 40 is positioned in the neck portion 38 to facilitate flitting and removal of the hood 34.

The hood 34 includes a facial opening 266. A front edge 268 of the hood 36 is fast with a peripheral stepped portion 270 of the helmet 28 positioned rearwardly of the internal portion 264.

The helmet 18 includes a fastening structure 42 (FIG. 9) that is positioned over the hood 34, in use. The fastening structure 42 includes a central web 44. The web 44 is dimensioned to extend from a region proximate a hairline of the diver, to a region just below the base of the skull of the diver. Three pairs of opposed straps 46 extend from the web 44. These include a pair of crown straps 46.1 which are fastened to the base member 32 and include a winding adjustment 48 to permit the straps 46.1 to be drawn downwardly so that the web 42 bears downwardly on the diver's head 36. A pair of intermediate straps 46.2 is fast with the internal portion 264 of the helmet 18. The intermediate straps 46.2 include a buckle arrangement 50 that the internal portion 264 can be drawn against the face 24 to urge the sealing member 28 against the face 24.

A pair of lower straps 46.3 is also fast with the internal portion 264. The lower straps 46.3 also include a buckle arrangement 52 so that the internal portion 264 can be drawn against the face 24. The lower straps 46.3 are positioned so that they tighten the web 42 against the base of the diver's skull. Thus, the fastening structure 42 makes use of the natural shape of the diver's head 36 to secure the mask assembly 20 in position.

The helmet 18 includes a rigid cover assembly 54. The rigid cover assembly 54 includes a pair or cover plates 56. One of the cover plates 56.1 is fixed to the base member 32 while the other cover plate 56.2 is pivotally connected to the base member 32 with a pivot arrangement 58. The cover member 56.2 is pivotal between an open condition in which it allows access to the fastening structure 42 and a closed condition in which the fastening structure 42 is covered.

The cover plates 56 are of a lightweight, rigid, moulded plastics material or fibreglass. Furthermore, the cover members 56 are shaped to impart an aesthetically pleasing appearance to the helmet 18.

The helmet 18 incorporates a pressure relief valve assembly 60 on each side of the helmet 18. The pressure relief valve assembly 60 may be positioned so that, when the helmet 18 is in position, each valve assembly 60 is aligned with a diver's ear to inhibit excessive air pressure build up in the ear canals.

Figure 10:
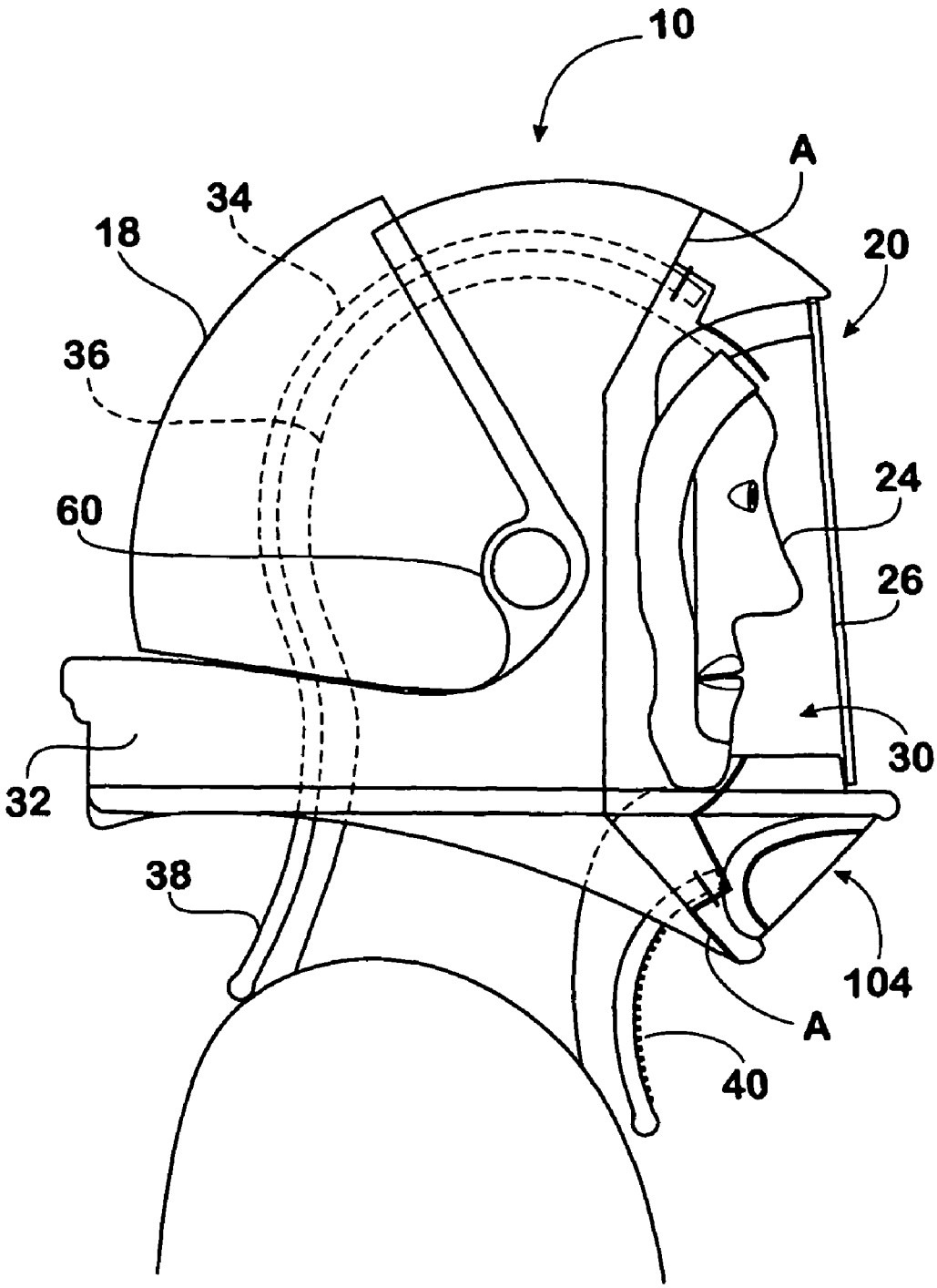
FIG. 10 shows another side view of the diving apparatus of FIG. 1, indicating an air valve assembly for the ears.
Figure 11:
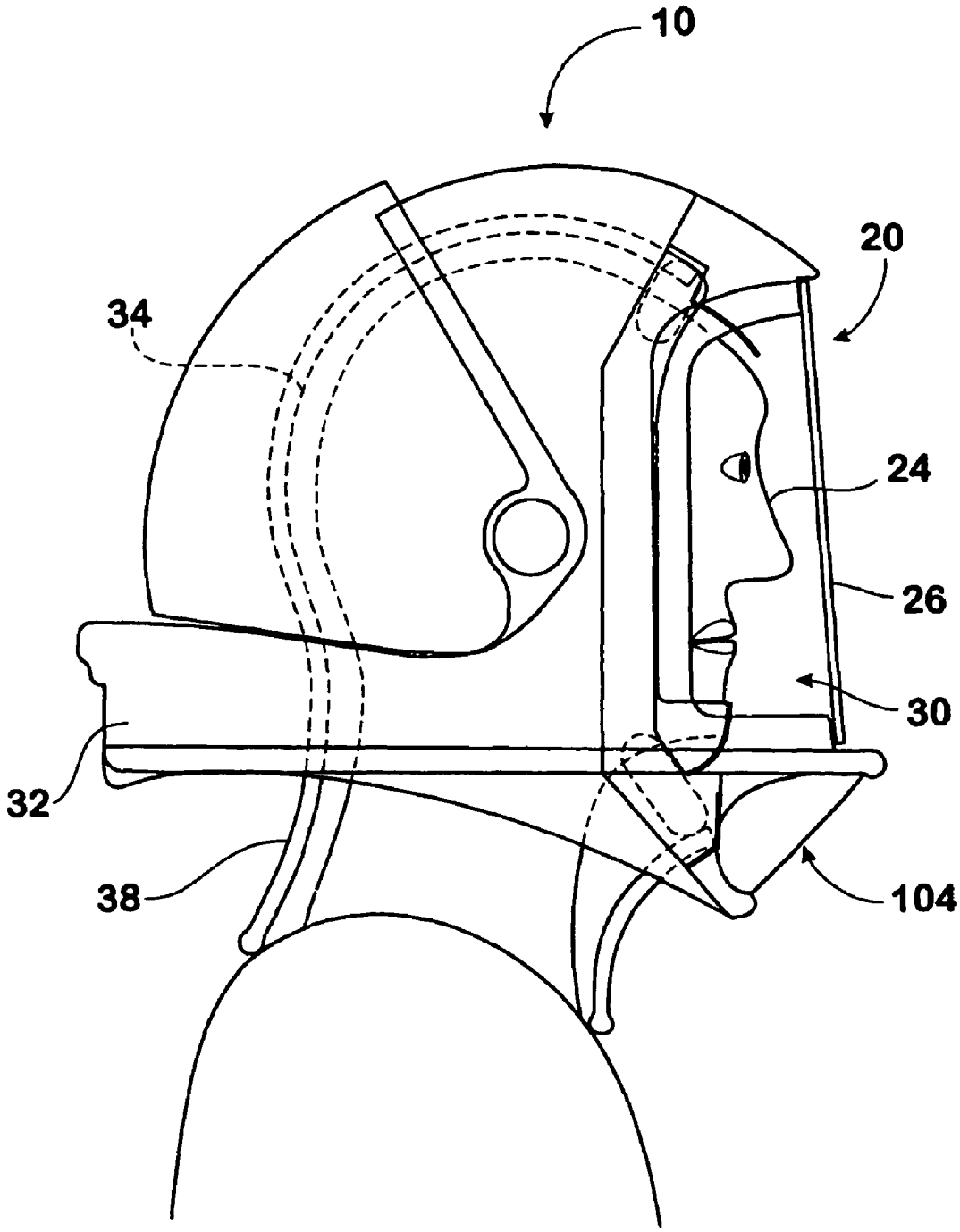
FIG. 11 shows another side view of the diving apparatus of FIG. 1, indicating an alternative mask assembly.
Figure 12:
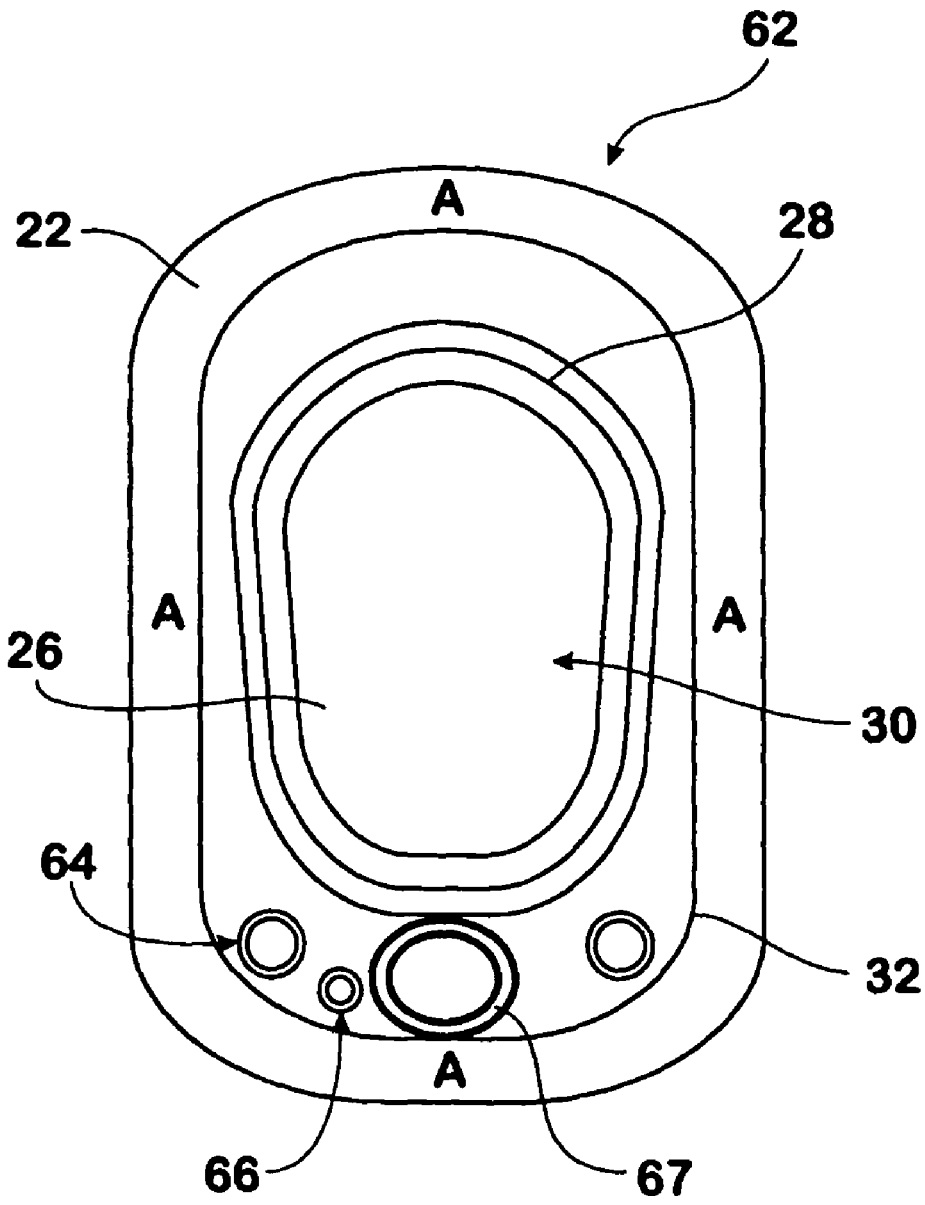
FIG. 12 shows a back view of part of the diving apparatus of FIG. 1, indicating a facial bulkhead.

As can be seen in FIGS. 10 and 12, the internal portion 264 of the helmet 18 supports a flexible facial bulkhead 62. The flexible facial bulkhead 62 defines a pair of regulator air intake openings 64 in fluid communication with the breathing air space 30.

An exhaust valve 67 is positioned in the bulkhead 62. The exhaust valve 67 is a non-return valve that is oriented to permit the egress of water that may accumulate in the breathing air space 30. Thus, by blowing, a diver can eject the water from the air space 30 out of the exhaust valve 67, without the concern for water entering the air space 30.

The bulkhead 62 also defines an emergency air intake opening 66.

Figure 6:
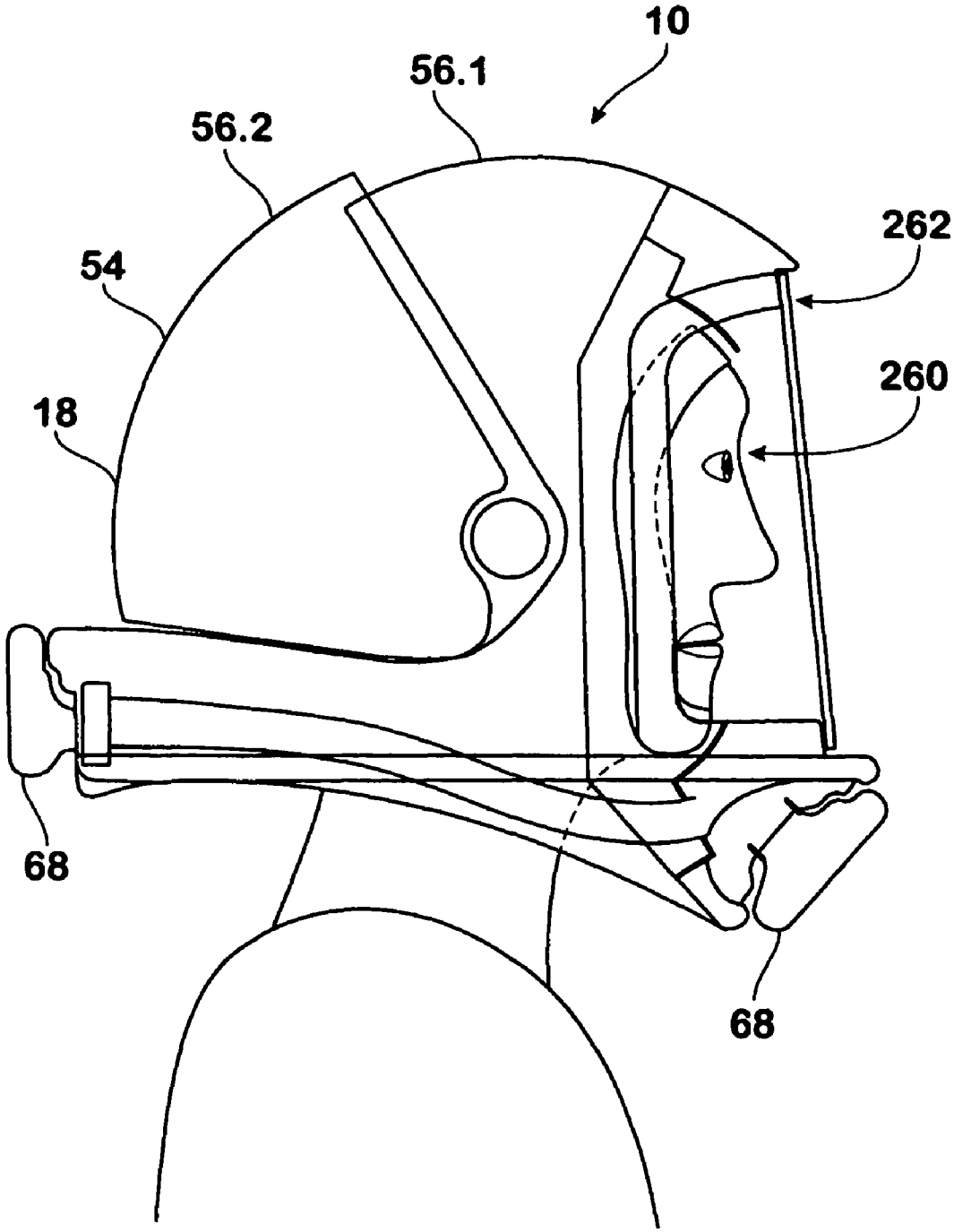
FIG. 6 shows a side view of the diving apparatus of FIG. 1, indicating two possible positions for a regulator.
Figure 7:
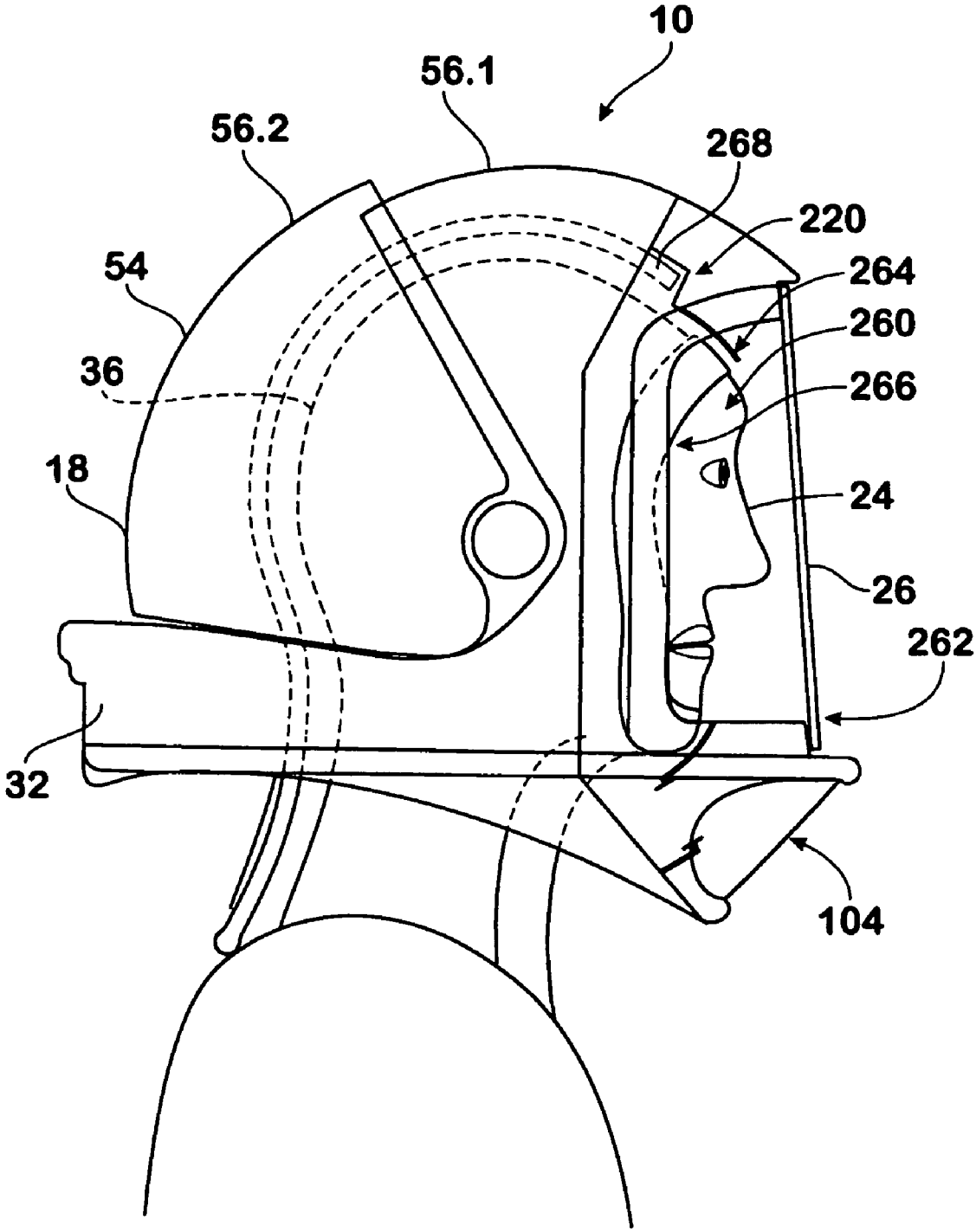
FIG. 7 shows another side view of the diving apparatus of FIG. 1.
Figure 8:
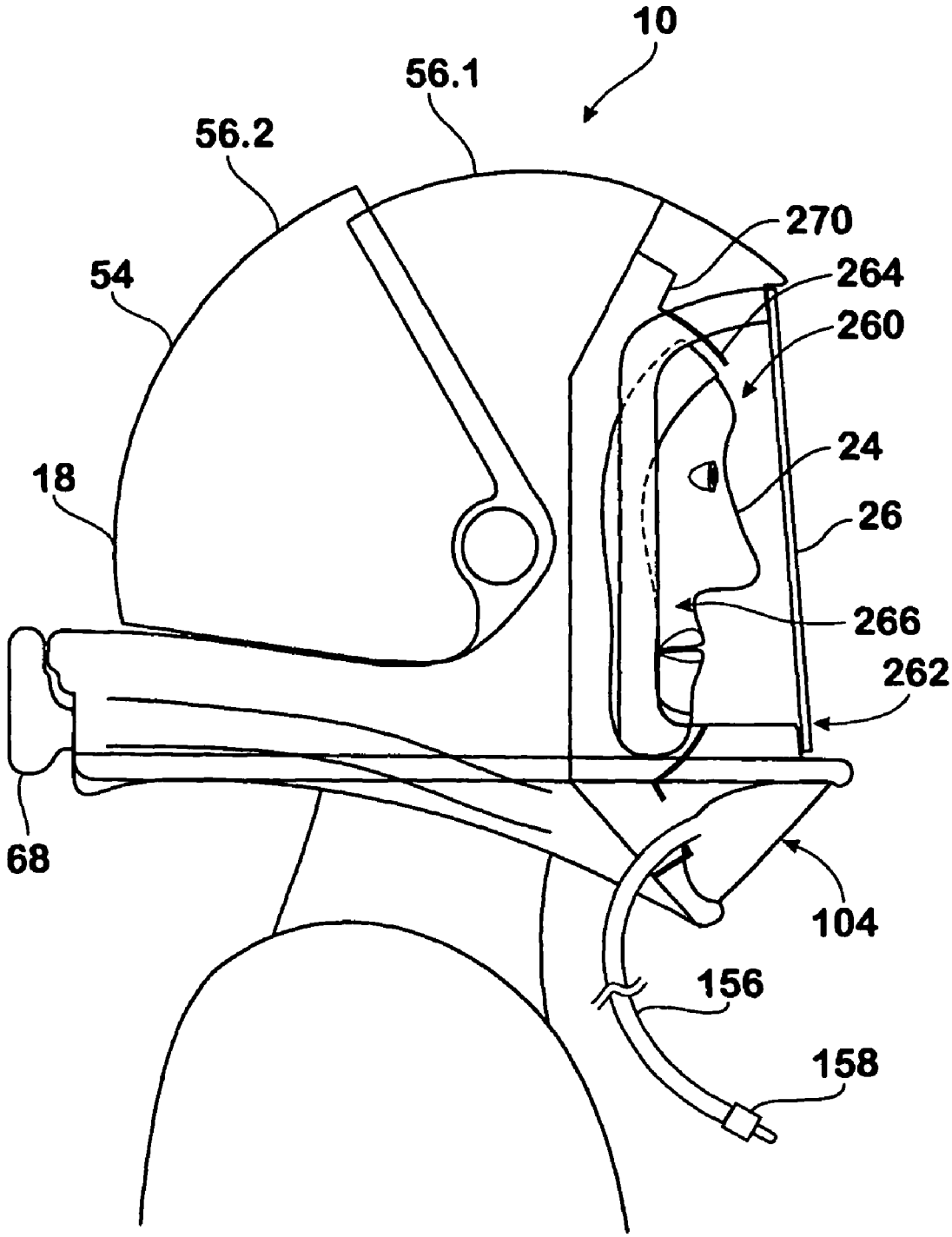
FIG. 8 shows another side view of the diving apparatus of FIG. 1, indicating a secondary emergency air jack.
Figure 9:
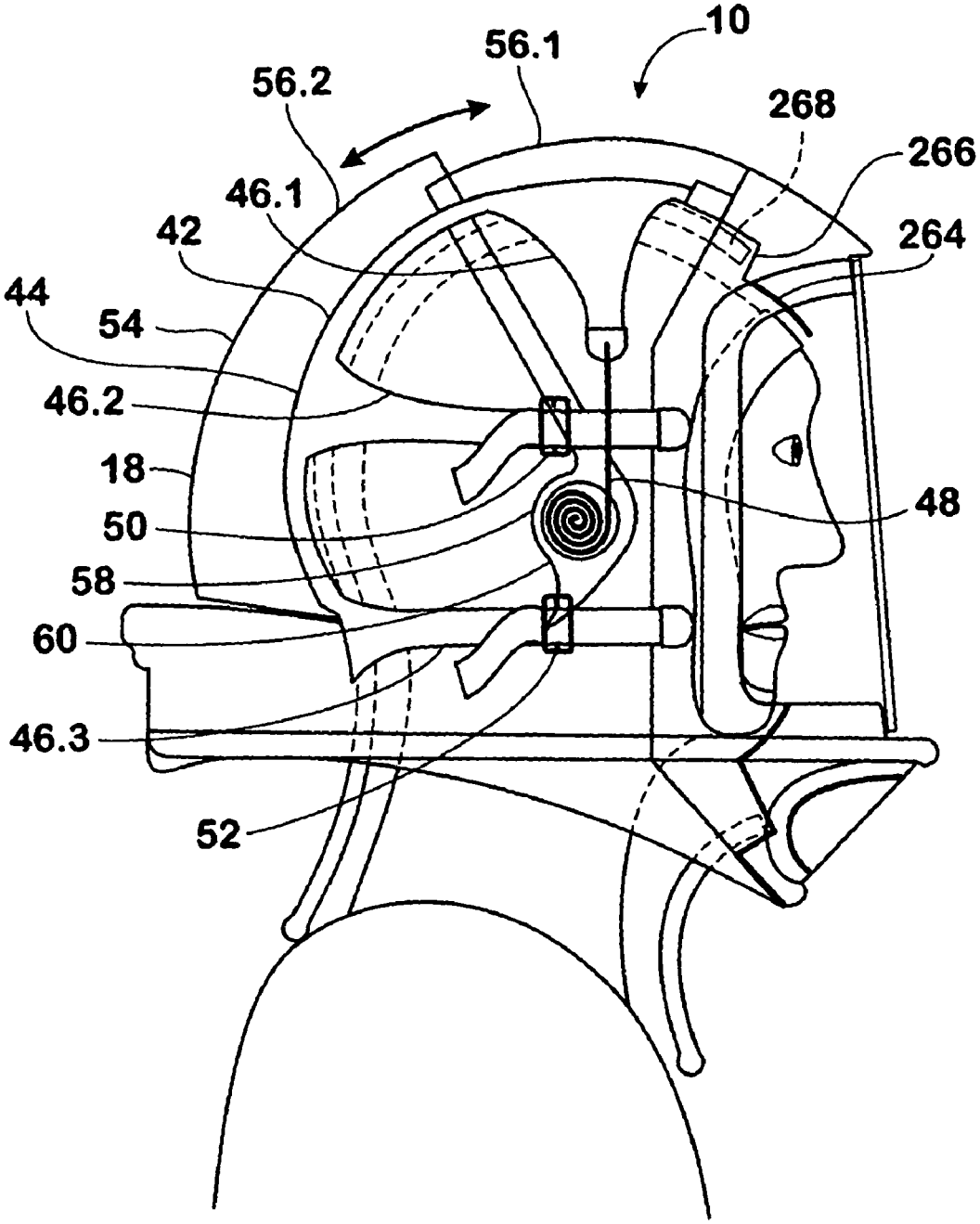
FIG. 9 shows another side view of the diving apparatus of FIG. 1, indicating a cover assembly and fastening structure.

A regulator 68 is mounted on the base member 32. The regulator 68 can be positioned either at the back of the helmet 18 or at a frontal side of the helmet 18. The two possible positions are shown in FIG. 6. An outlet of the regulator 68 is connected to the air intake openings 64. The regulator 68 is similar to a standard SCUBA regulator in that it permits the egress of exhaust air.

It will be understood by those familiar within diving that it is important that the pressure behind and in front of the eardrums be equalized. Usually, in order to do this, it is necessary for a diver to pinch his or her nostrils dosed and to blow until the eardrums pop. With the prior art diving apparatus, this is a simple procedure since there is no physical obstruction to facial access at the opening of the helmet. With other apparatus, the mask is configured to permit a diver to pinch his or her nostrils. However, these masks obscure a diver's face and are therefore not conducive to photography.

Thus, the base member 32 defines an equalization opening 104 that is dimensioned so that a diver can pass his or her fingers through the opening 104. It will be appreciated that some form of sealing arrangement is required to inhibit the ingress of an excessive amount or water.

FIGS. 13 to 17 show one embodiment of such a sealing arrangement in the form of a closure assembly 106 that is positioned on the base member 32 to cover the opening 104.

The closure assembly 106 includes a pair of closure flaps 108 in the form of an upper closure flap 108.1 and a lower closure flap 108.2 that extend across the opening 104. A zipper arrangement 110 is positioned on the flaps 108 to zip the flaps 108 together. The flaps 108 are of neoprene while the zipper arrangement 110 is the same as that found on a wet suit. The closure assembly 106 includes an internal flap 116 that also extends across the opening 104. The internal flap 116 overlies the zipper arrangement 110 and is also of neoprene.

A backing plate 112 is fast with an inner side of the flap 108.1, while a pair of spaced backing plates 114 is fast with an inner side of the internal flap 116. The plates 112 and 114 also extend across the opening 104. The backing plates 112, 114 are resiliently flexible and thus provide form for the flaps 108.1, 116. It will be appreciated that the base member 32 is curved outwardly, This provides a mechanical advantage in an external direction so that the flaps 108, 116 are retained in a sealing condition. Thus, when the zipper arrangement 110 is opened, the flaps 108, 116, remain in position. When a diver urges his or her hand against the flaps 108, 116, the flaps 108, 116 buckle to permit the diver to reach his or her nostrils so that equalization can be performed.

Figure 18:
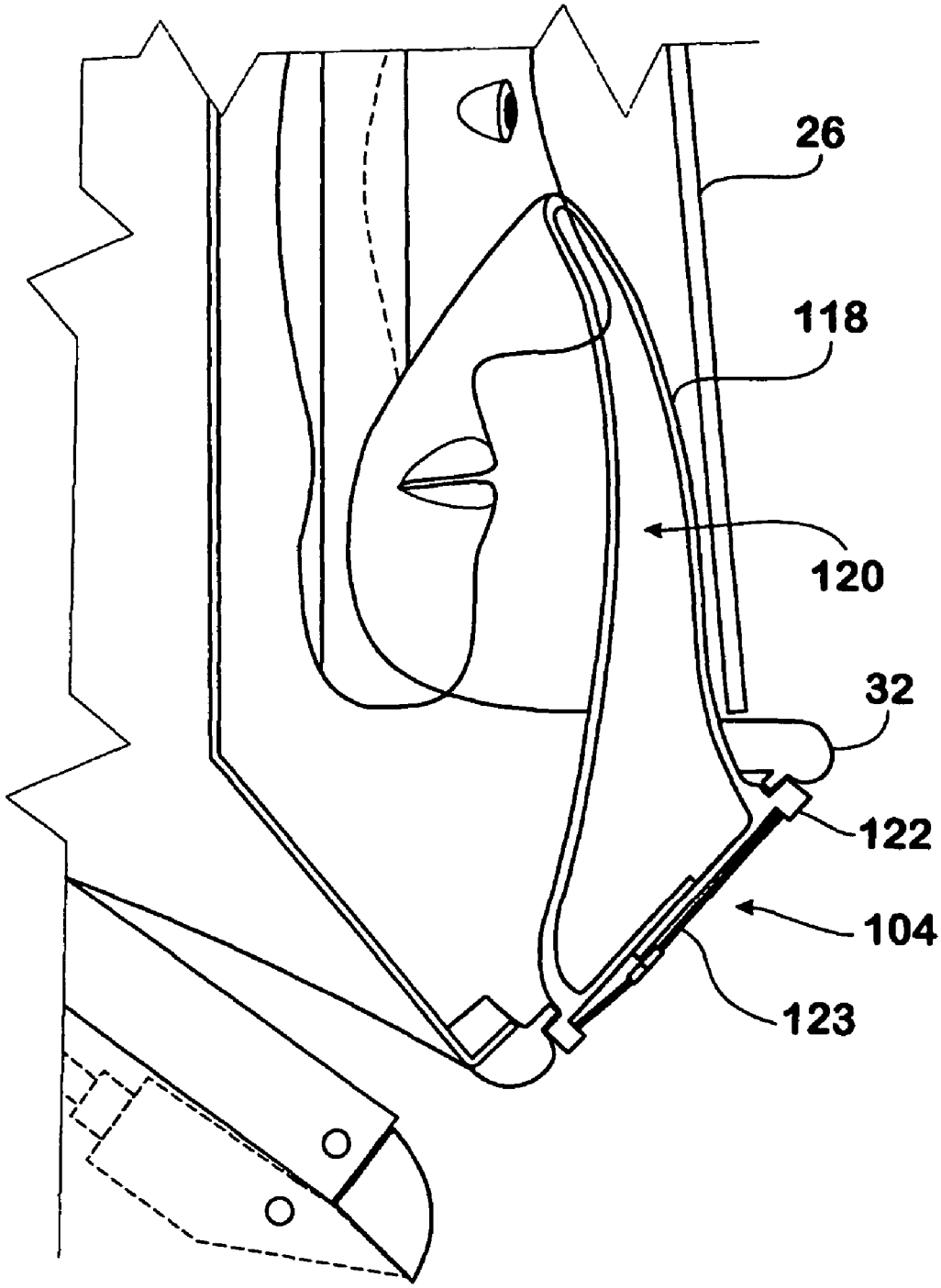
FIG. 18 shows a side view of part of the diving apparatus of FIG. 1, illustrating an alternative closure assembly for the equalization opening, in an operative condition.
Figure 19:
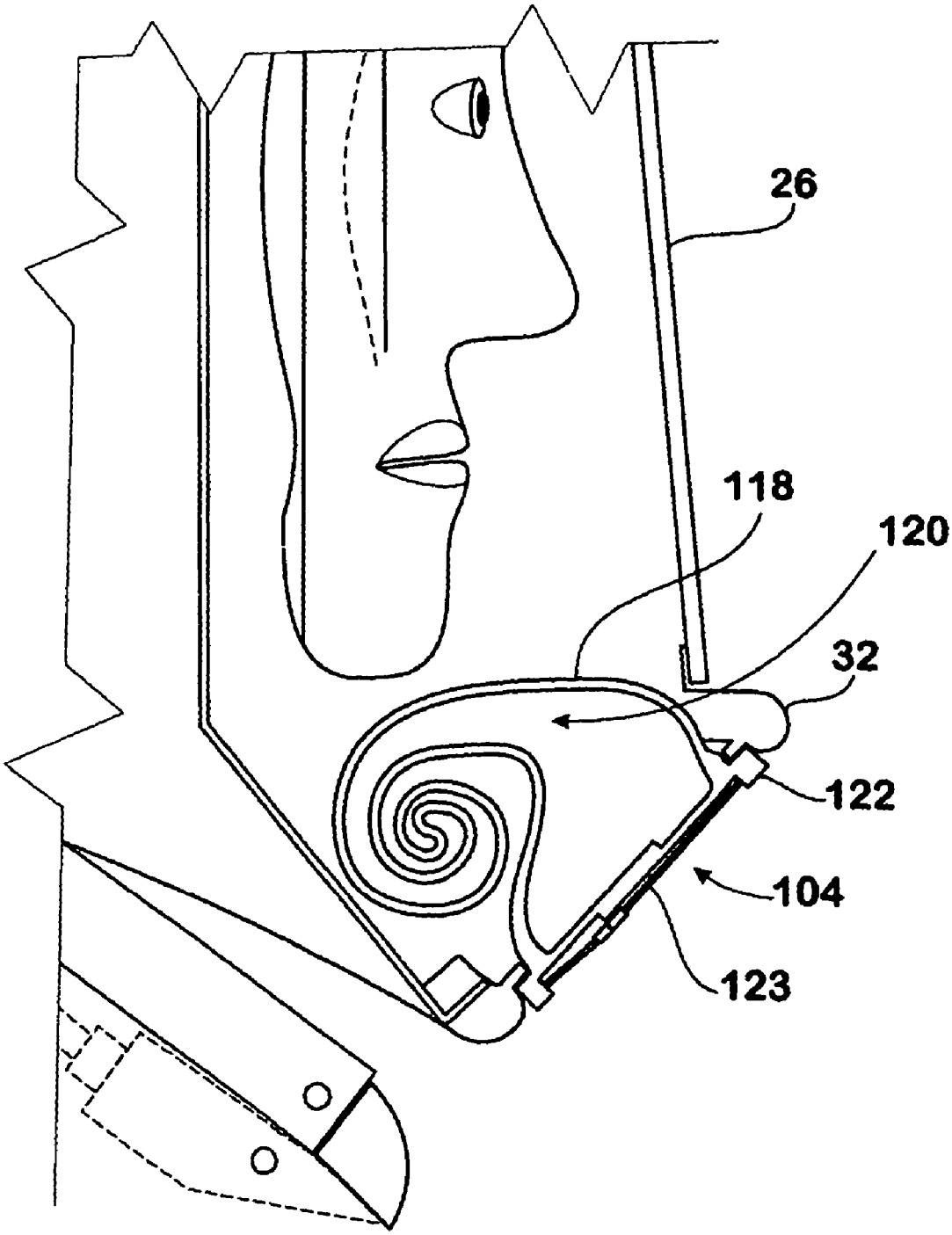
FIG. 19 shows a side view of the alternative closure assembly, in an inoperative condition.
Figure 20:
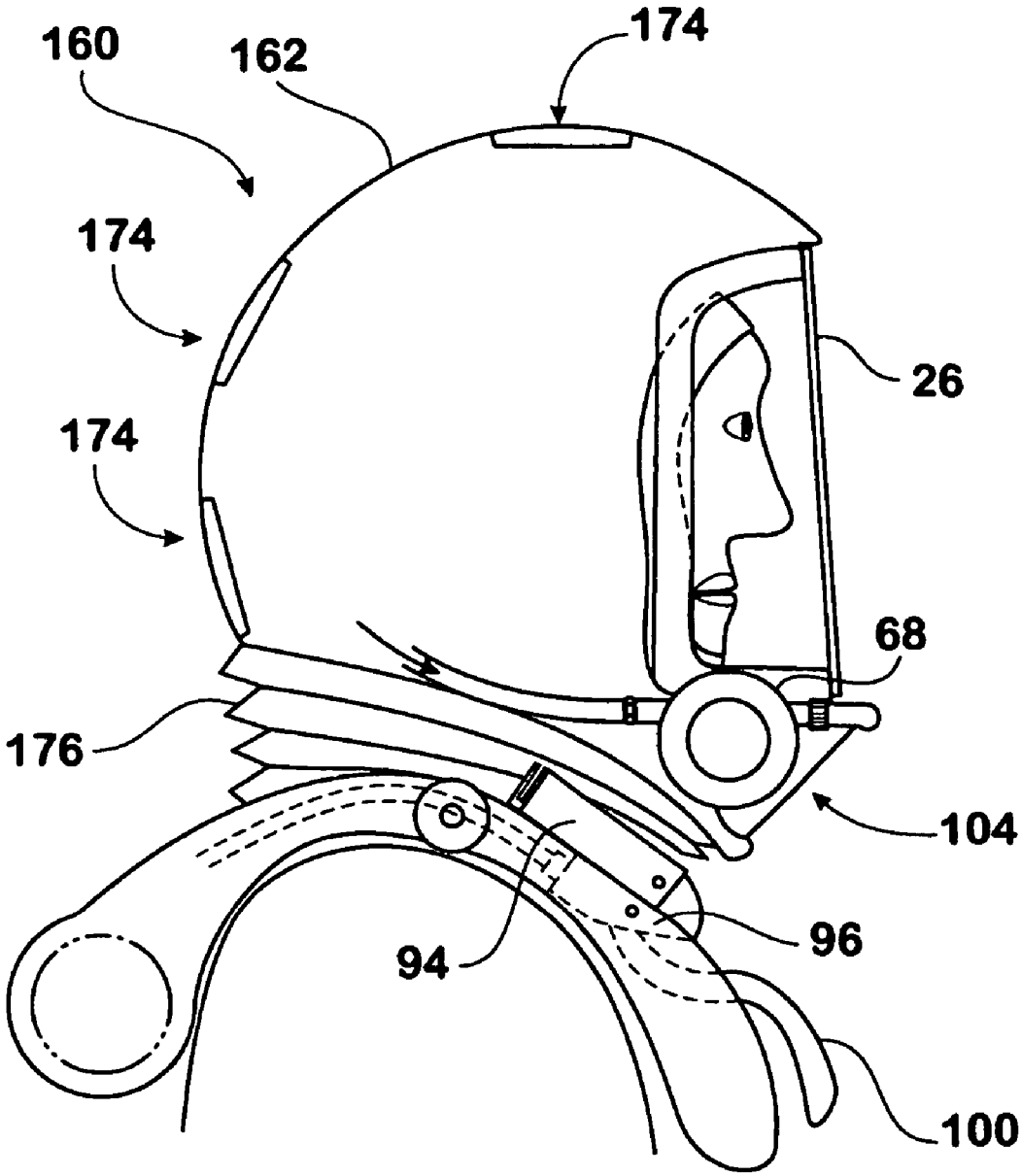
FIG. 20 shows a side view of a third embodiment of a diving apparatus, in accordance with the invention.
Figure 21:
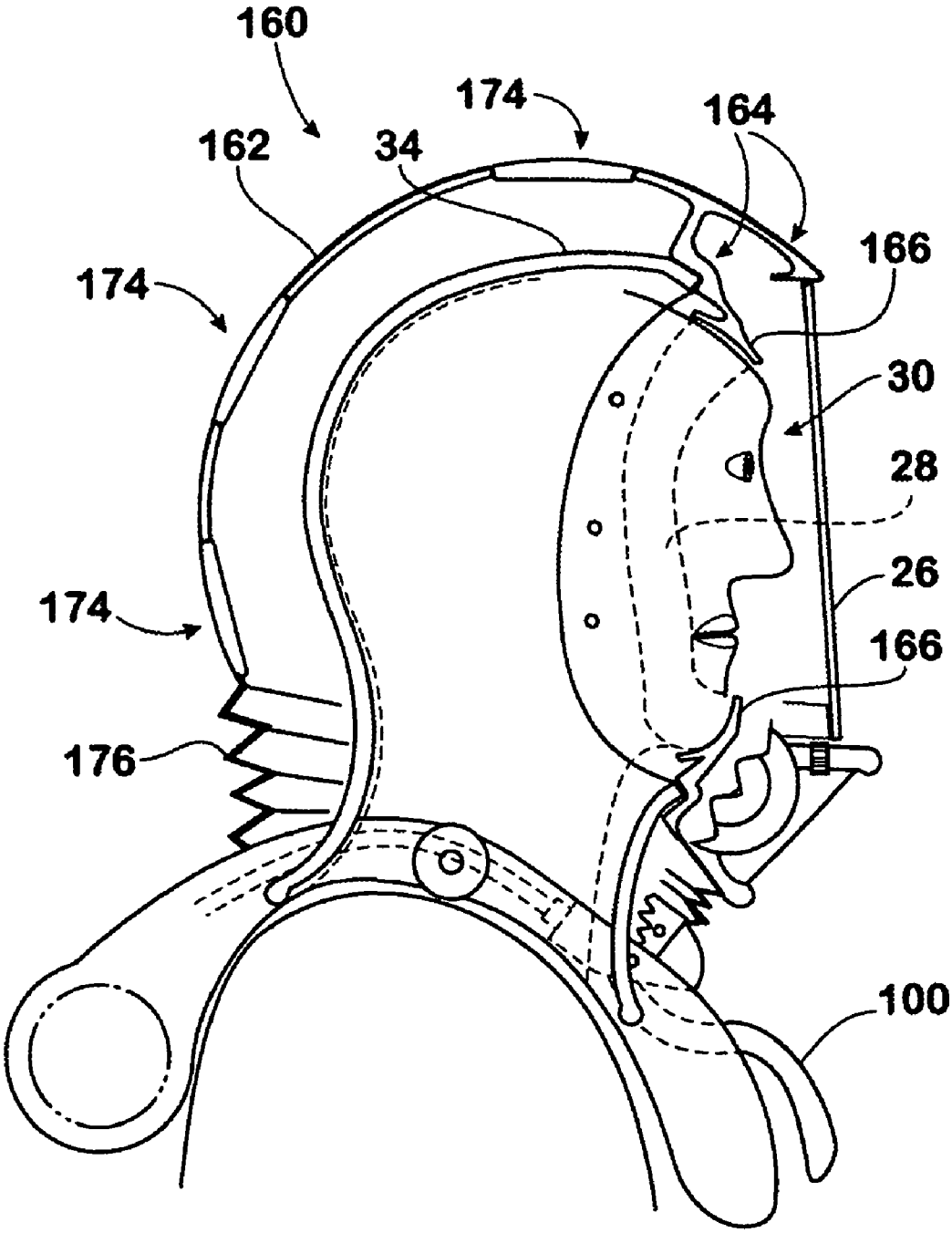
FIG. 21 shows a cut away side view of the diving apparatus of FIG. 20.
Figure 22:
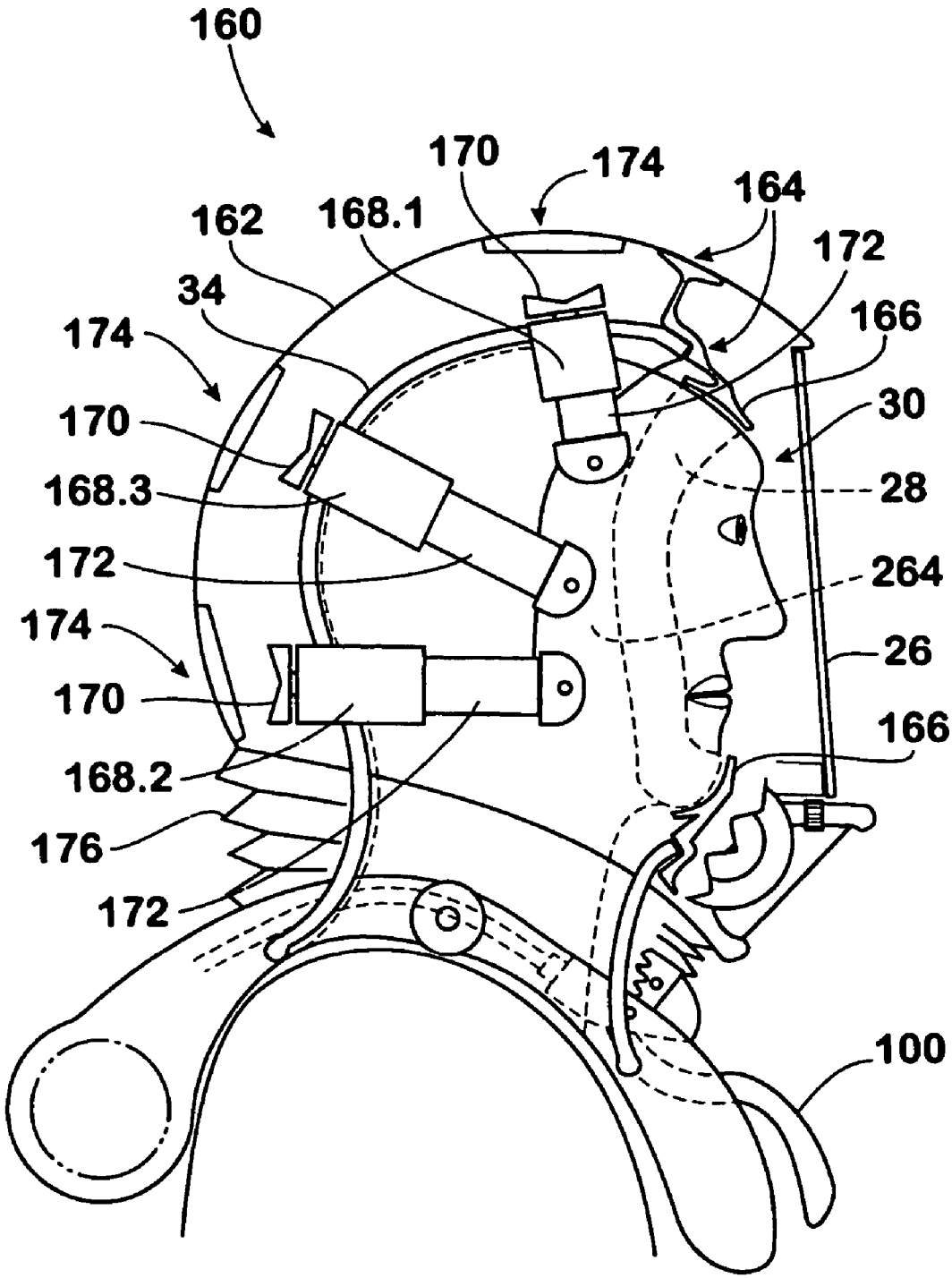
FIG. 22 shows a further cut away side view of the diving apparatus of FIG. 20.

In FIGS. 18 and 19, another possible embodiment of a sealing arrangement is shown. In this case, the sealing arrangement includes a flexible membrane 118 that is positioned to span the equalization opening 104. The flexible membrane 118 is dimensioned to define a pocket 120 into which a diver can insert his fingers to reach his or her face 24. It will thus be appreciated that the membrane 118 engages the diver's nostrils, in use. As can be seen in FIGS. 18 and 19, the membrane 118 is foldable between an operative condition and an inoperative condition, respectively.

The membrane 118 is positioned on a rim member 122 that engages the base member 32. A flap assembly 123 is also positioned on the rim member 122 to dose the pocket 120.

The base member 32 is connected to the support member 14 with a flexible fabric collar 70. The collar 70 includes an air bladder 72 that is inflatable to adjust the collar 70 for comfort. The air bladder 72 is built into the collar 70. An inflating mechanism 74 is mounted on the support member 14 and is in fluid communication with the bladder 72 so that the bladder 72 can be inflated to a desired level. A dump valve 76 is positioned on the bladder 72 so that the bladder 72 can be deflated, when necessary. It will be appreciated that the flexible collar 70 allows the diver to move his or her head relative to the support member 14.

The apparatus 10 includes a safety valve assembly in the form of a shuttle valve 78 that is mounted on the support member 14. The shuttle valve 78 is as described in Applicant's International Application no. PCT/JP01/07363. The shuttle valve 78 includes a primary inlet 80, a secondary inlet 82, a primary outlet 84 and a secondary outlet 86. The shuttle valve 78 is configured so that, while air inlet pressure at the primary inlet 80 remains above a predetermined value, the primary inlet 80 is retained in an open condition and the secondary inlet 82 is retained in a closed condition. When the air inlet pressure at the primary inlet 80 drops below the predetermined value, the primary inlet 80 is dosed and the secondary inlet 82 is opened.

The apparatus 10 includes a connecting valve assembly in the form of a non-return inlet valve 94 that is mounted on the support member 14. A quick release coupling mechanism or quick coupler 96 is mounted on the inlet valve 94 to permit a hooker hose 98 to be coupled to the inlet valve 94. The quick coupler 96 includes a handle 100 that facilitates operation of the quick coupler 96. The inlet valve 94 is configured so that the inlet valve 94 is placed in an open condition when the hooker hose 98 is coupled to the inlet valve 94 and a closed condition when the hooker hose 98 is released from the inlet valve 94. An outlet of the inlet valve 94 is connected to the primary inlet 80 of the shuttle valve 78.

The apparatus 10 includes a back up air supply in the form of an emergency air tank 88. The emergency air tank 88 is of the type which is between approximately 30 cm and 40 cm long with a diameter of 10 to 20 cm. Thus, the emergency tank 88 is substantially smaller than a standard SCUBA tank. The emergency air tank 88 includes an emergency air regulator 90. The emergency air regulator 90 is connected to the secondary inlet 82 of the shuttle valve 78 with an air hose 92. Thus, when the air inlet pressure at the primary inlet 80 of the shuttle valve 78 drops below a predetermined value, the shuttle valve 78 operates to direct air from the emergency air tank 88 to the regulator 68.

An alarm mechanism 124 is connected into the air hose 92. The alarm mechanism 124 is configured to generate an alarm signal if a flow of air is detected in the hose 92.

The secondary outlet 86 of the shuttle valve 78 is connected to the inflating mechanism 74 with a suitable air hose 102. Thus, the inflating mechanism 74 can be used to inflate the bladder 72 with air from the hooker hose 98.

A cushion means in the form of an air bladder 126 is positioned on an inside of the support member 14. The air bladder 126 is positioned so that, when the support member 14 is on a diver's shoulders, the bladder 126 is interposed between the diver and the support member 14. A manual inflating tube 128 is attached to the bladder 126 so that the bladder 126 can be inflated by the diver for comfort.

The apparatus 10 includes a secondary emergency air hose 156 that is connected to the base member 32 at the emergency air intake opening 66. The air hose 156 terminates at an emergency air jack 158 that permits an emergency air supply hose to be connected to the air hose 155.

Figure 3:
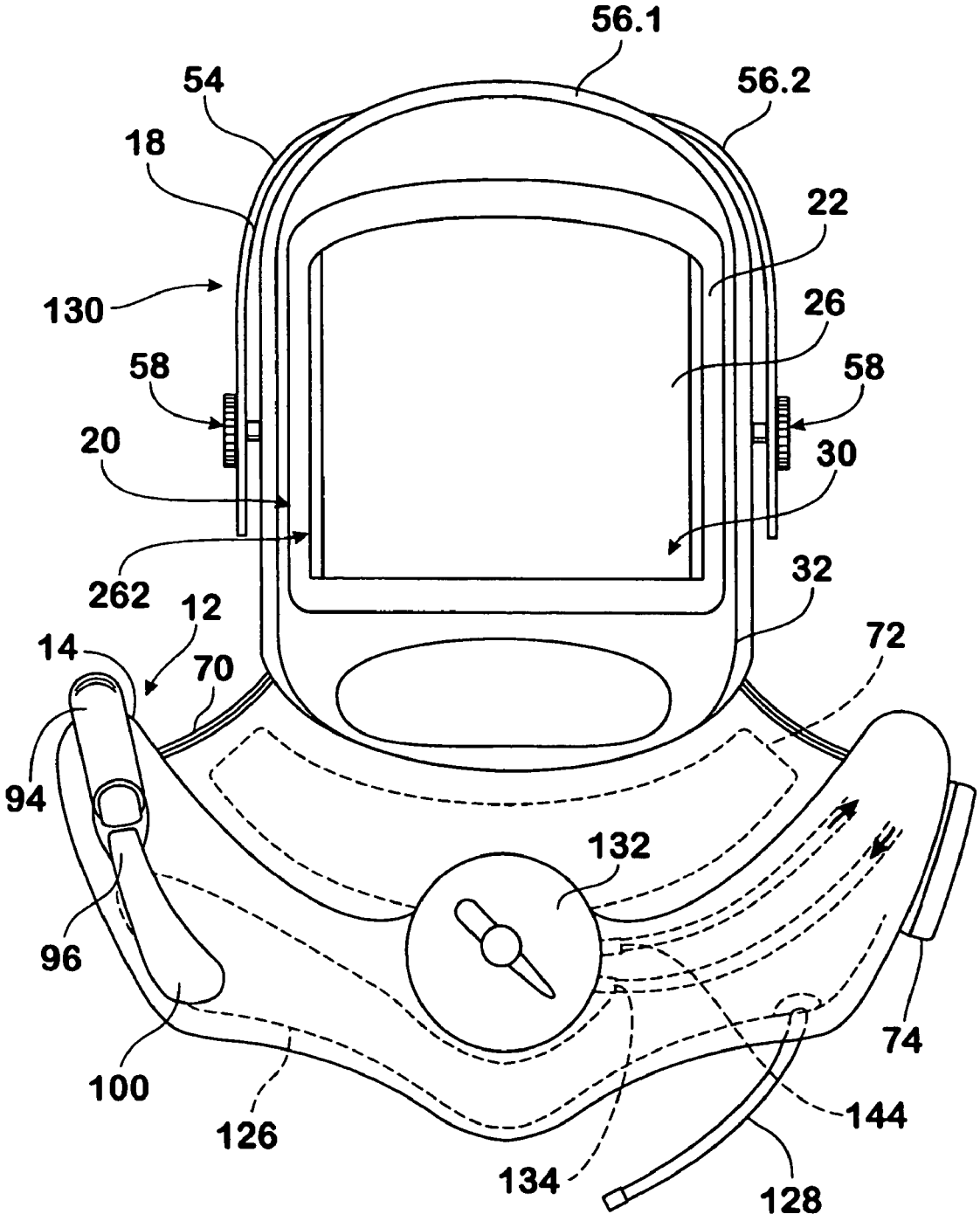
FIG. 3 shows a front view of a second embodiment of a diving apparatus, in accordance with the invention.
Figure 4:
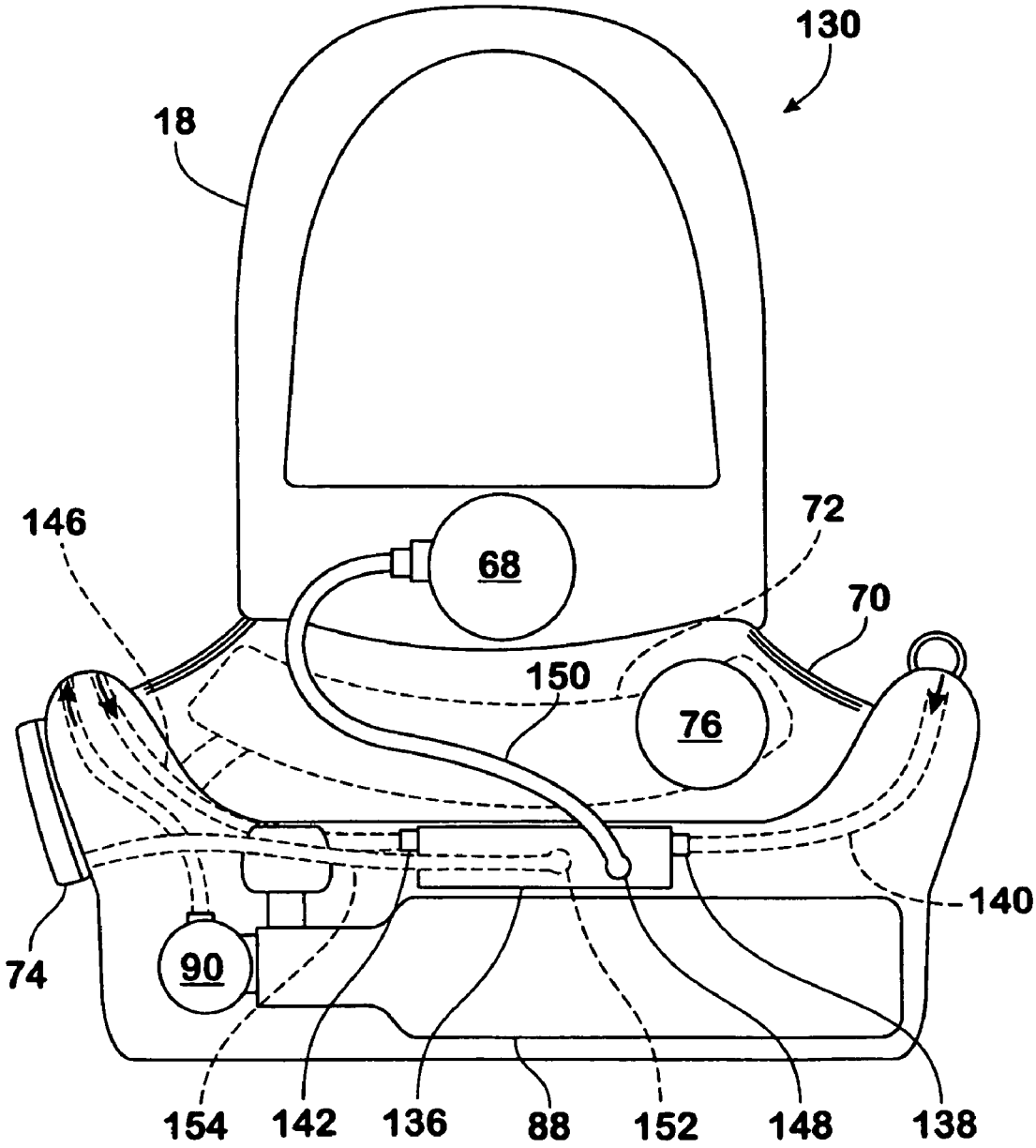
FIG. 4 shows a rear view of the diving apparatus of FIG. 3.
Figure 5:
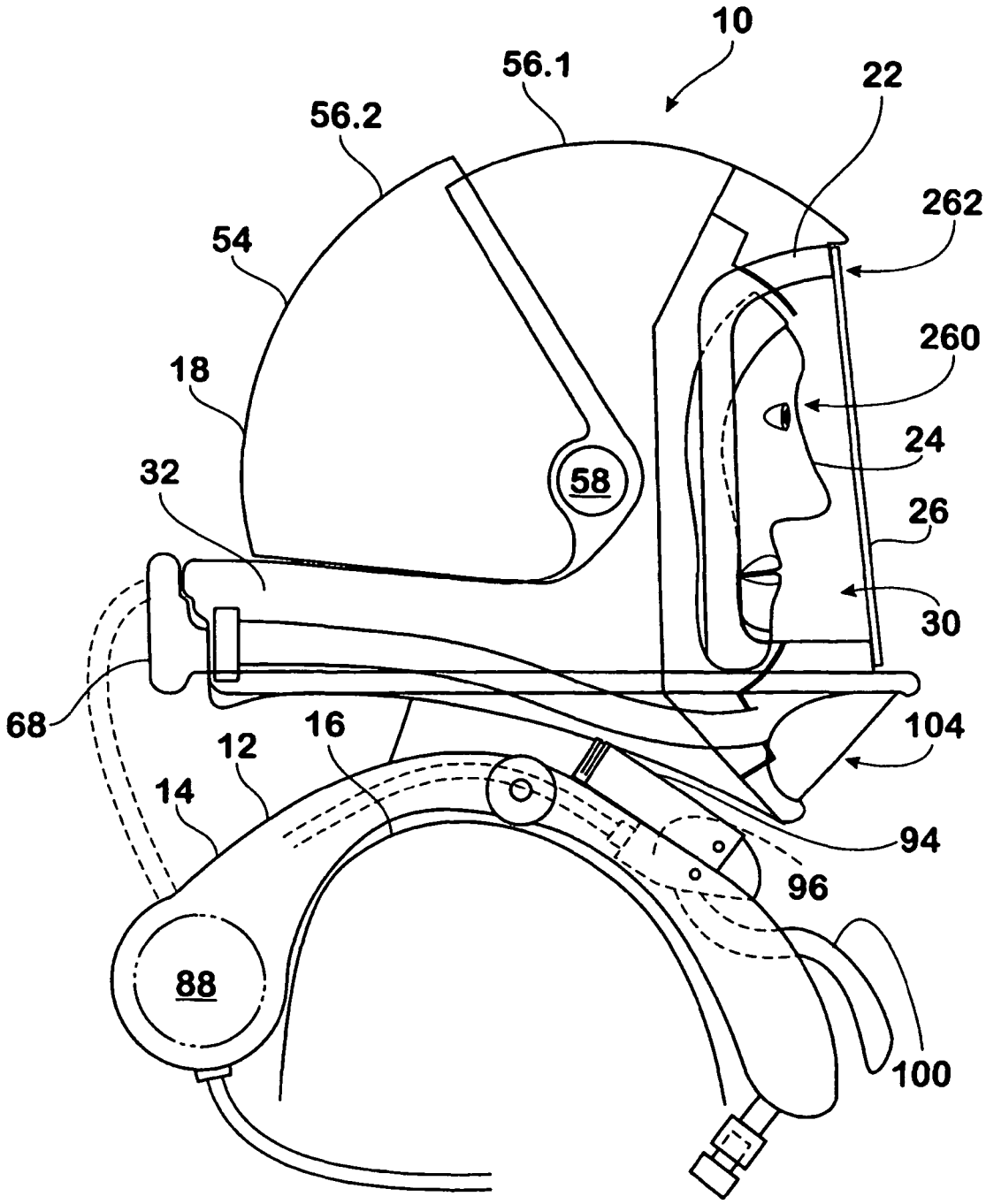
FIG. 5 shows a side view of the diving apparatus of FIG. 1.

In FIGS. 3 and 4, reference numeral 130 generally indicates a second embodiment of a diving apparatus in accordance with the invention. With reference to FIGS. 1, 2 and 5 to 13, like reference numerals refer to like parts, unless otherwise specified.

Instead of the shuttle valve 78, the apparatus 130 includes a manually operable valve 132 and a manifold 136. The manifold 136 has a primary inlet 138 that is connected to the valve 94 via an air hose 140. The manifold 136 has a secondary inlet 142 that is connected to an outlet 144 of the valve 132 with an air hose 146. The manifold 136 has a primary outlet 148 that is connected to the regulator 6B with an air hose 150. The manifold has a secondary outlet 152 that is connected to the inflating mechanism 74 with an air hose 154.

Thus, instead of the automatic changeover provided by the apparatus 10, the apparatus 130 allows the diver to select changeover from hooker air to emergency tank air and vice versa. It will thus be appreciated that the apparatus 130 is particularly suited for use by instructors or dive guides.

In FIGS. 20 to 23, reference numeral 160 generally indicates a third embodiment of a diving apparatus, in accordance with the invention. With reference to FIGS. 1 to 19, like reference numerals refer to like parts, unless otherwise specified.

The apparatus 160 does not include the rigid cover assembly 54. Instead, the apparatus 160 includes a cover member 162 of a resiliently flexible material that is fixed to the mask frame 22. The cover member 162 defines suitable mounting formations 164 that engage the hood 34 and the sealing member 28.

The cover member 162 can form a unitary moulding together with the sealing member 28 as shown at 166. Thus, the cover member 162 is of a suitable elastomeric material such as silicon or the like.

The mounting formations 164 are configured so that the cover member 162 is spaced from the hood 34.

The apparatus 160 includes three elongate fasteners 168 that extend over the hood 34 to be connected to the internal portion 264 of the helmet 18. The fasteners 168 are in the form of a top fastener 168.1 that extends over a top of the hood, a bottom fastener 168.2 that extends over the base of the diver's skull and an intermediate fastener 168.3 that is positioned between the top and bottom fasteners 168.1, 168.2. Thus, as with the straps 46, the fasteners 168 make use of a natural skull shape to achieve a secure attachment to the diver's head 36.

Each fastener 168 includes a rotary adjustment mechanism 170 engaged with an elongate connector 172. Each connector 172 has an end that is connected to the Internal portion 264.

Each rotary adjustment mechanism 170 and elongate connector 172 is configured so that rotary adjustment of the mechanism 170 causes linear adjustment of the connector 172. The cover member 162 defines three openings 174 that are aligned with corresponding adjustment mechanisms 170. The openings 174 are each dimensioned to permit the diver to access the adjustment mechanisms 170 through the openings 174.

The apparatus 160 includes a neckpiece 176 that is of a resiliently flexible material and is connected between the cover member 162 and the support member 14. The neckpiece 176 and the cover member 162 are of a one-piece, moulded construction. The cover member 162 and the neckpiece 176 are shaped to have an aesthetic appearance. Thus, the cover member 162 has a spherical profile and the neckpiece 176 has a corrugated profile.

Figure 23:
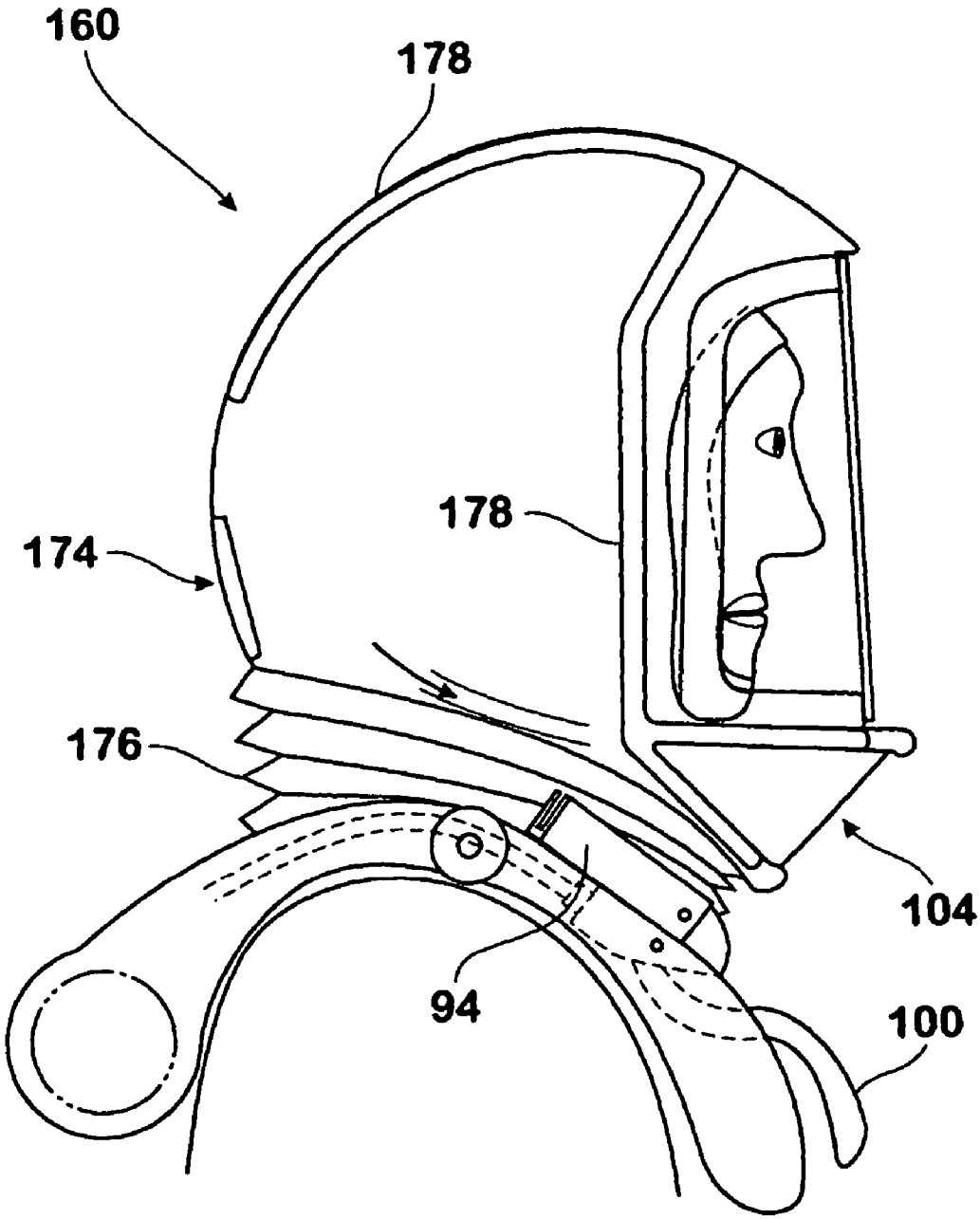
FIG. 23 shows still a further side view of the apparatus of FIG. 20.

As can be seen in FIG. 23, the apparatus 160 includes a bracing member 178 that forms a base for the cover member 162 to impart a desired shape to the cover member 162.

Figure 24:
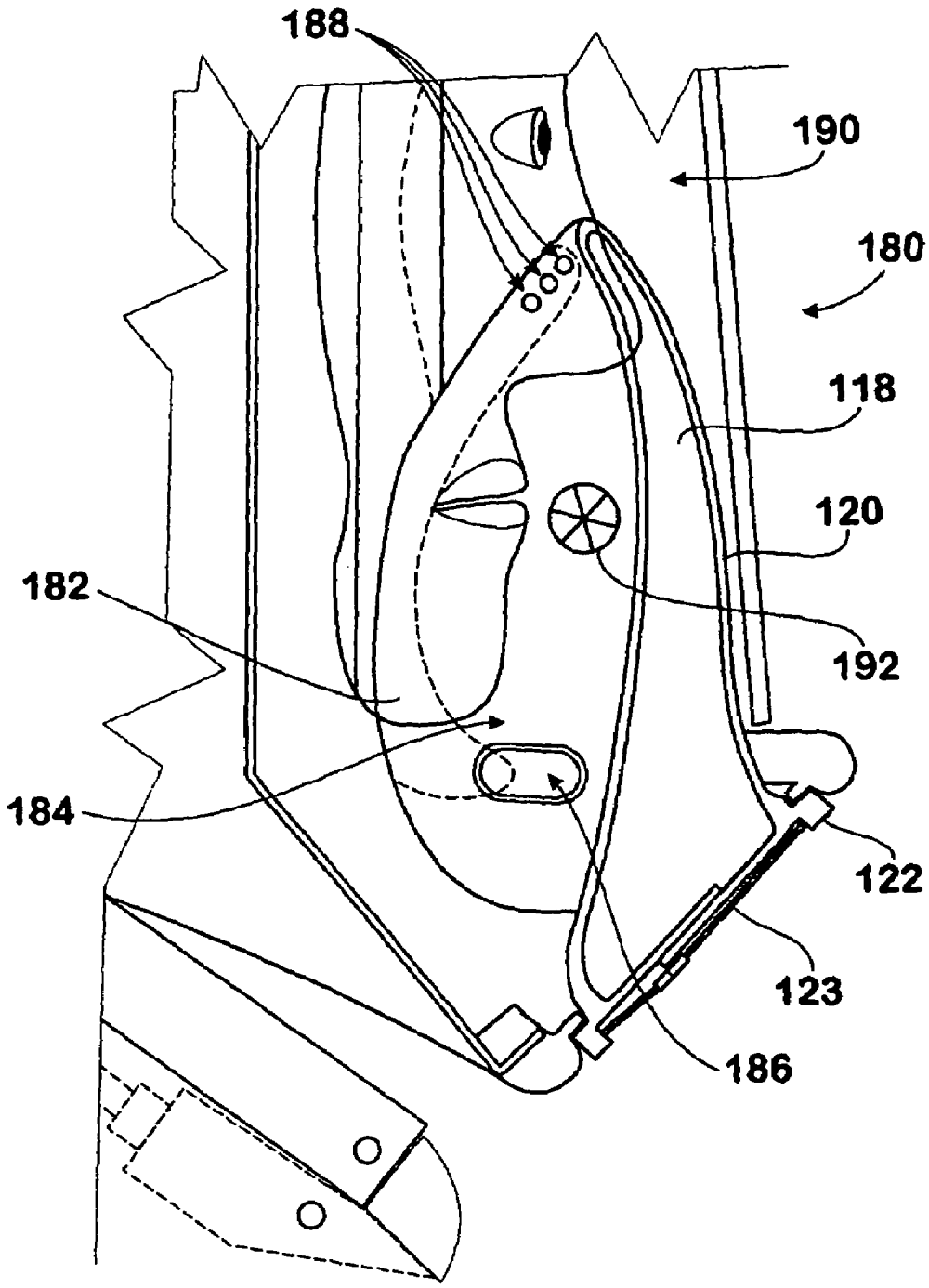
FIG. 24 shows a side view of a mask assembly of a fourth embodiment of a diving apparatus, in accordance with the invention.

In FIG. 24, reference numeral 180 generally indicates a fourth embodiment of a diving apparatus, in accordance with the invention. With reference to FIGS. 1 to 23, like reference numerals refer to like parts, unless otherwise specified.

The diving apparatus 180 includes the flap assembly 123 and pocket 120 as shown in FIGS. 18 and 19. In addition, the apparatus 180 includes a nose- and mouthpiece 182 that is mounted on the pocket 120. The nose and mouthpiece 182 is configured to engage the face 24 and to define a secondary breathing space 184 about the nose and mouth of the diver and an air space 190 between the nose- and mouthpiece 182 and the lens 26.

The nose- and mouthpiece 182 defines a regulator opening 186 to permit air from the regulator 68 to be fed into the secondary breathing space 184. The nose- and mouthpiece 182 also defines air outlet holes 188 that are in fluid communication with the air space 190 to facilitate defogging of the lens 26, A suction air valve 192 is mounted in the nose- and mouthpiece 182 also to facilitate defogging.

As with the pocket 120, the nose- and mouthpiece 182 is also of a resiliently flexible material. Thus, the nose- and mouthpiece 182 can be Folded away to present the diver's face for photographs, if necessary. Furthermore, the equalization procedure can still be carried out.

Figure 25:
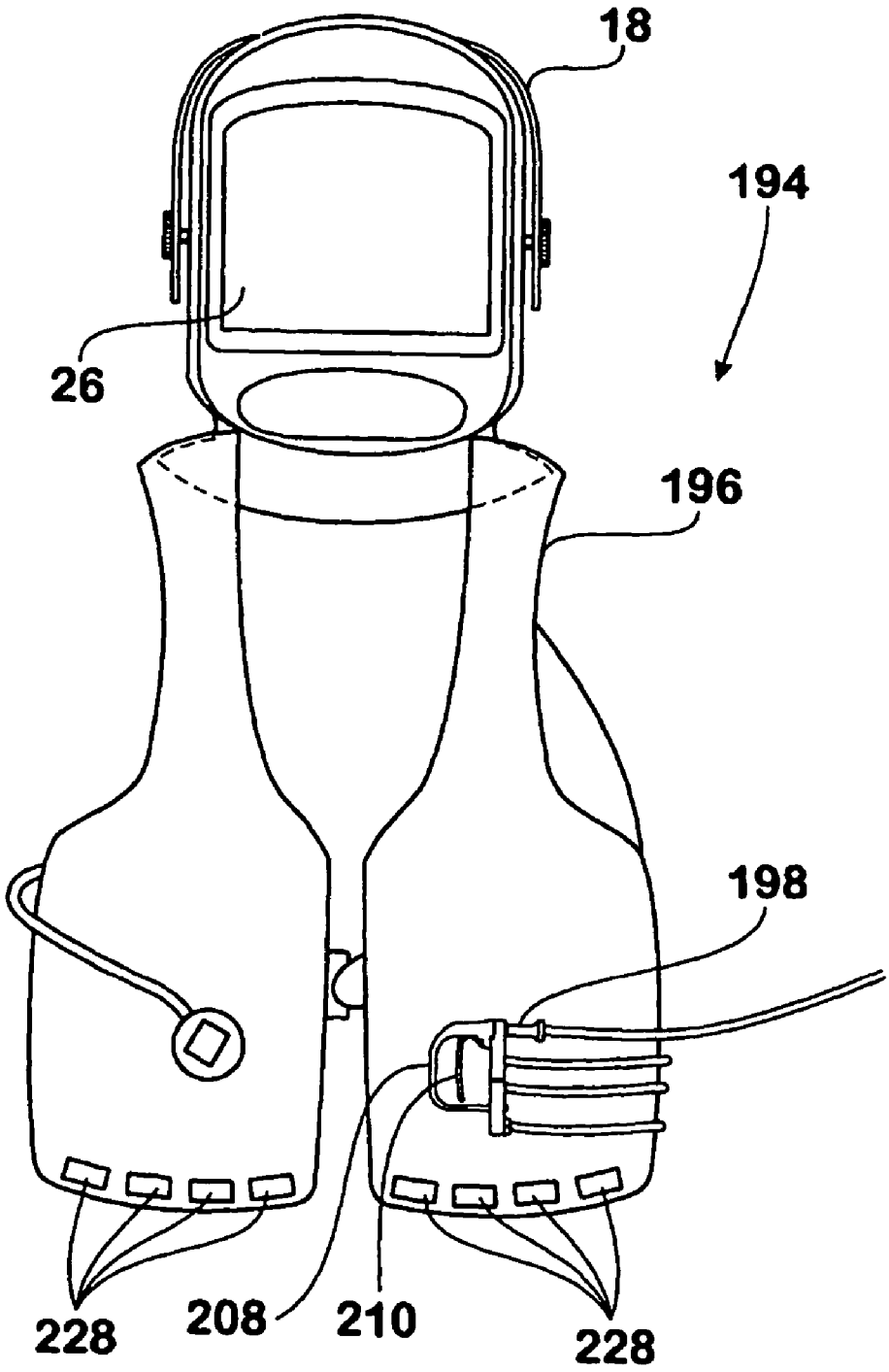
FIG. 25 shows a front view of a fifth embodiment of a diving apparatus, in accordance with the invention.

In FIG. 25, reference numeral 194 generally indicates a fifth embodiment of a diving apparatus. In accordance with the invention. With reference to FIGS. 1 to 24, like reference numerals refer to like parts, unless otherwise specified.

The diving apparatus 194 does not include the shoulder harness 12. Instead, the apparatus 194 includes a dive jacket 196 that is worn by the diver.

Figure 26:
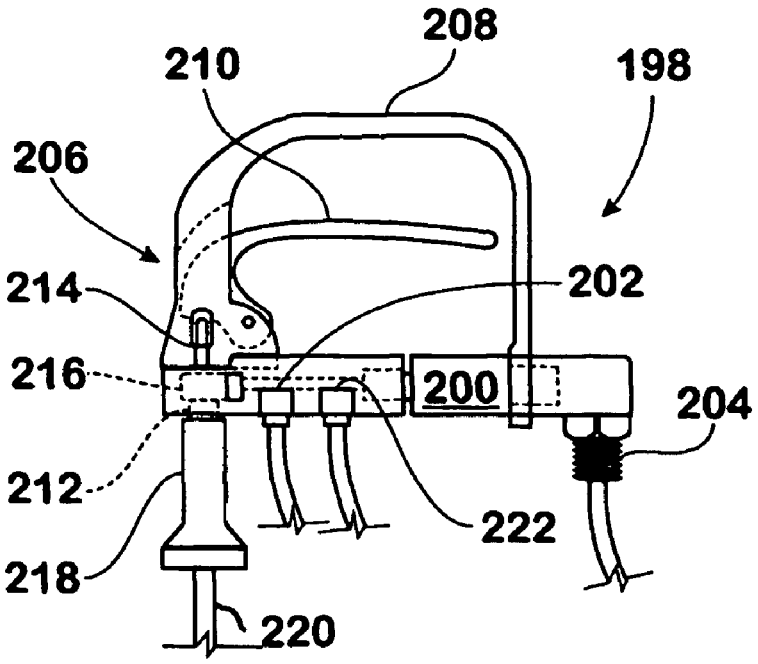
FIG. 26 shows a side view of one example of a quick release mechanism and safety valve assembly of the fifth embodiment of the diving apparatus.
Figure 27:
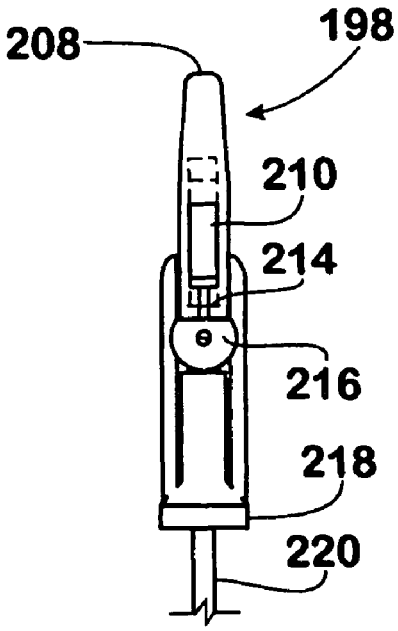
FIG. 27 shows a front view of the example of FIG. 26.

In FIGS. 26 and 27, reference numeral 198 indicates a safety valve assembly that forms part of the apparatus 194. The safety valve assembly 198 is mounted on the jacket 196 in a position in which the valve assembly 198 is readily accessible by a diver. The safety valve assembly 198 includes a shuttle valve 200 that is similar to the shuttle valve 78. Thus, the shuttle valve 200 has a primary outlet 202 that is connected to the regulator 68 and a secondary inlet 204 that is connected to the emergency air tank 88. In this embodiment, the emergency air tank 88 is mounted on the dive jacket 196.

The shuttle valve 200 further includes a primary inlet 212 that is defined by a quick connect assembly 214 incorporating a stop valve 216 that cooperates with a quick connect assembly 218 of a hooker pipe 220. The shuttle valve 200 also includes a secondary outlet 222 that is connected to the inflating mechanism 74.

The safety valve assembly 198 also includes a quick release mechanism 206. The quick release mechanism 206 includes a handle 208 and a release lever 210 that is pivotally mounted on the handle 208. The release lever 210 is operatively connected to the quick connect assembly 214 so that, when manipulated, the lever 210 acts on the connect assembly 214 to release the hooker pipe 220.

Figure 28:
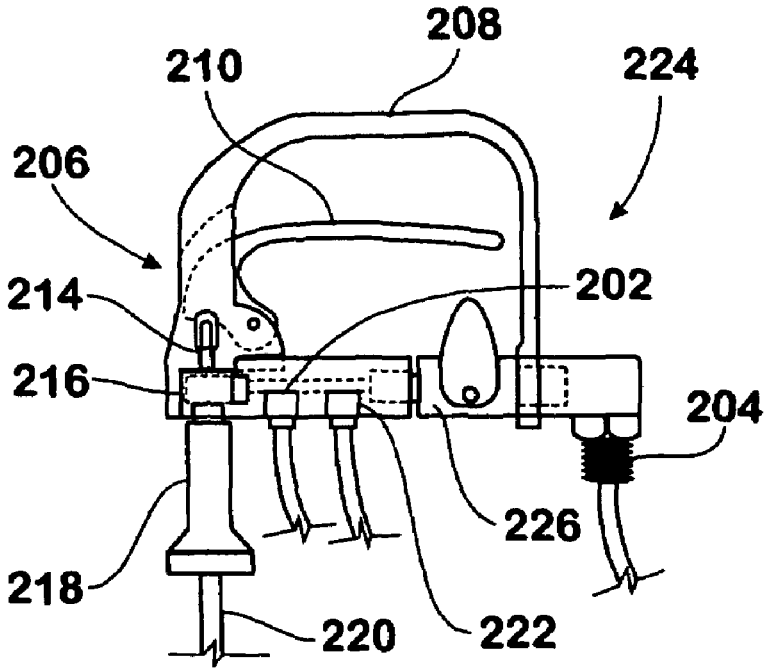
FIG. 28 shows a side view of another example of a quick release mechanism and safety valve assembly of the fifth embodiment of the diving apparatus.
Figure 29:
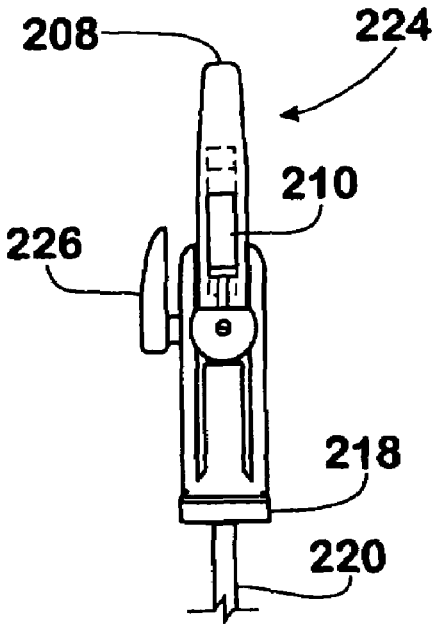
FIG. 29 shows a front view of the example of FIG. 28.

In FIGS. 28 and 29, reference numeral 224 generally indicates another example of a safety valve assembly for the apparatus 194. With reference to FIGS. 26 and 27, like reference numerals refer to like parts, unless otherwise specified.

Instead of the shuttle valve 200, the safety valve assembly 224 includes an on/off valve 226 that has a handle 228 so that a diver can open or close the valve 226.

The dive jacket 196 is weighted at 228 to provide the necessary negative buoyancy. The dive Jacket 195 is fast with the collar 70.

Figure 30:
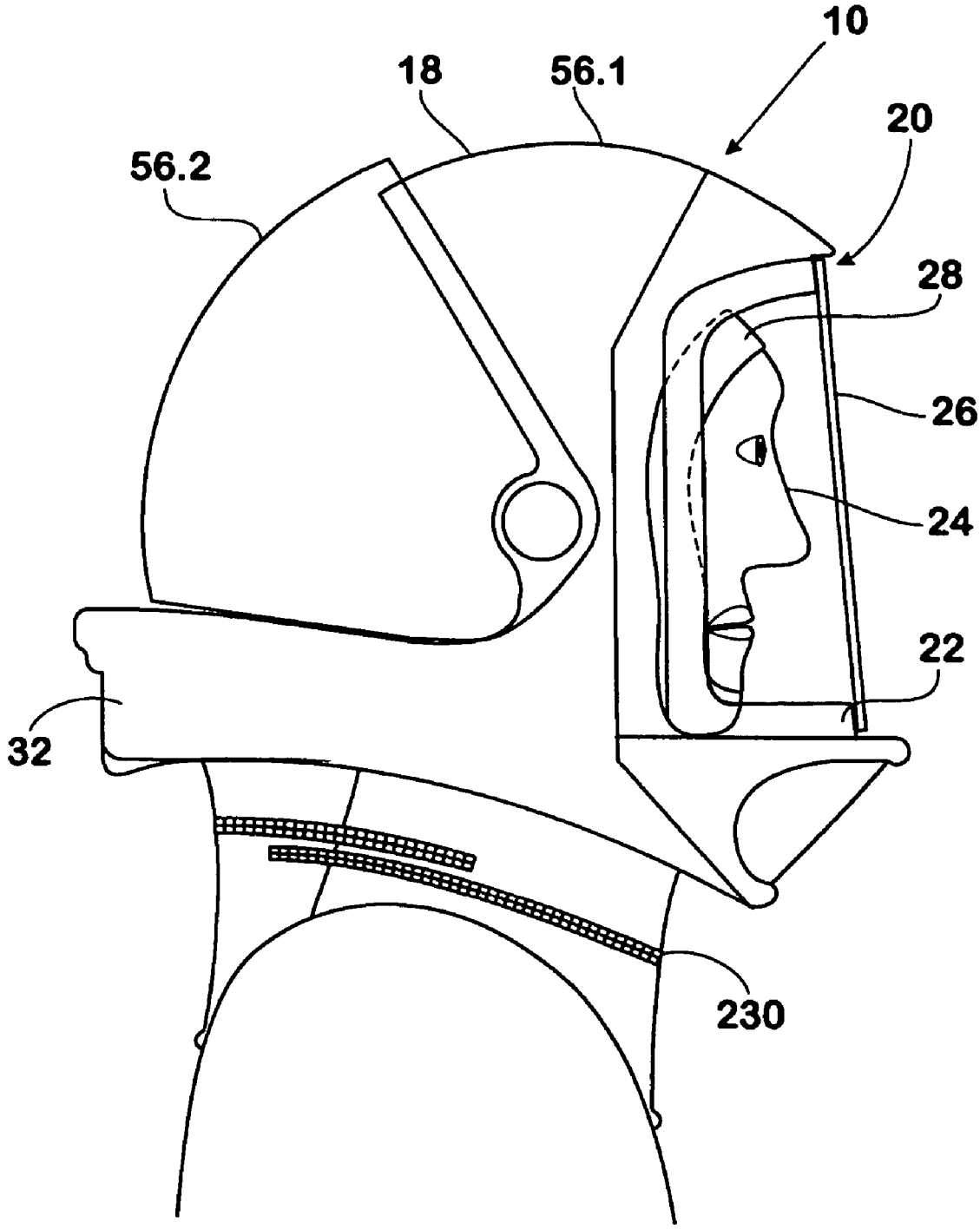
FIG. 30 shows the dive apparatus incorporating a zipper arrangement to facilitate easy removal of the helmet of the dive apparatus.

In FIG. 30, there is shown the collar 70 with a circumferential zip fastener 230. The zip fastener 230 extends all the way around the collar 70 so that the helmet 18 can easily be removed.

Figure 31:
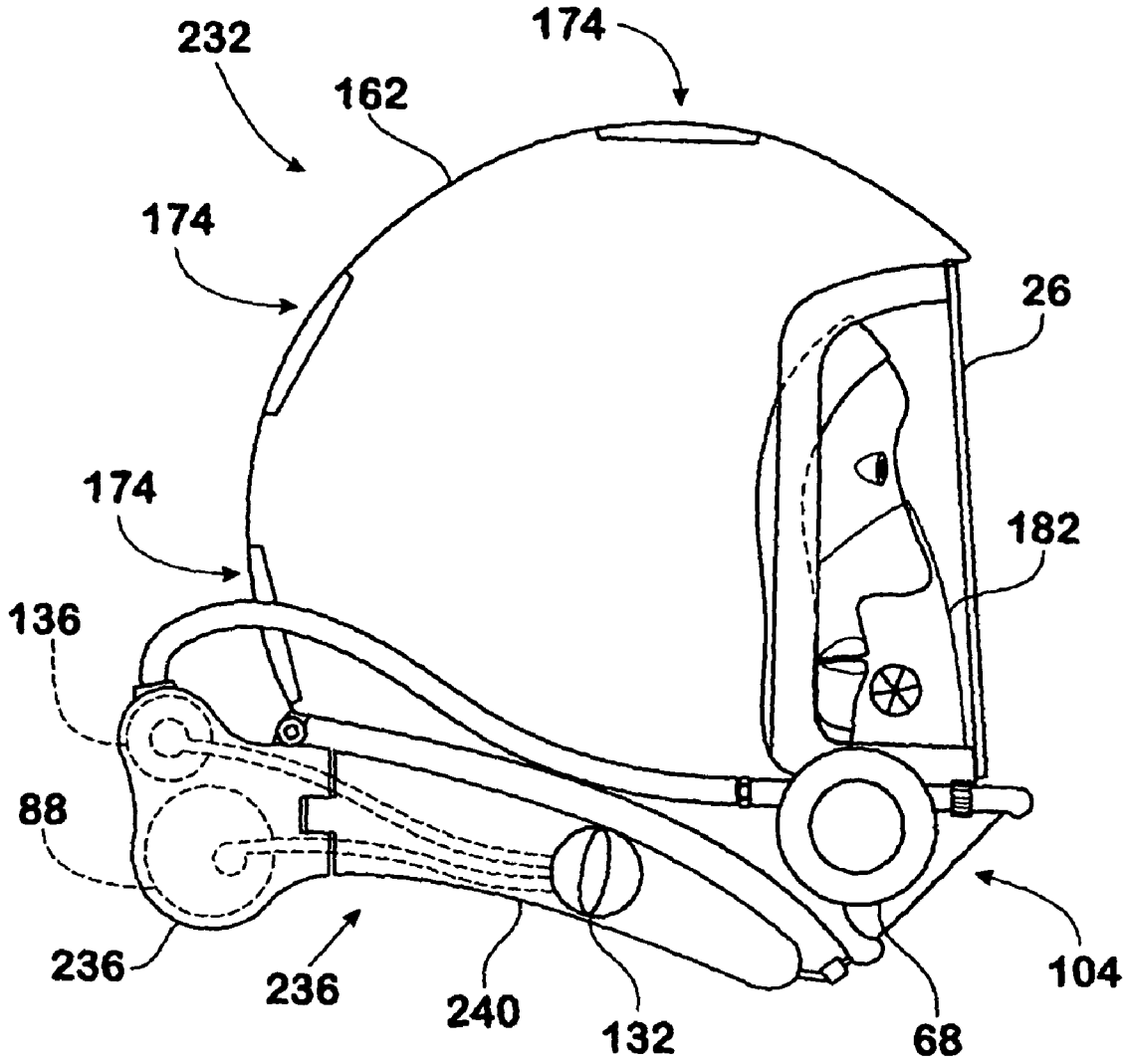
FIG. 31 shows a side view of a sixth embodiment of a diving apparatus, in accordance with the invention.

In FIG. 31, reference numeral 232 generally indicates a sixth embodiment of a diving apparatus, in accordance with the invention. With reference to FIGS. 1 to 30, like reference numerals refer to like parts, unless otherwise specified.

The apparatus 232 does not include the shoulder harness 12 or the dive jacket 196. Instead, the apparatus 232 includes a neck engagement mechanism 234 that is configured to be seated on a diver's shoulders and to engage the diver's neck.

The neck engagement mechanism 234 includes a support structure 236. A pair of engagement arms in the form of a first engagement arm 238 and a second engagement arm 240 is pivotally connected to the support structure 236. The support structure 236 is configured to be positioned behind the diver's head while the engagement arms 238, 240 are received about the diver's neck.

The emergency air tank 88 is mounted on the support structure 236. The manifold 136 is also mounted on the support structure 236. It will be appreciated that the shuttle valve 78 could also be mounted on the manifold 136, when appropriate.

Figure 32:
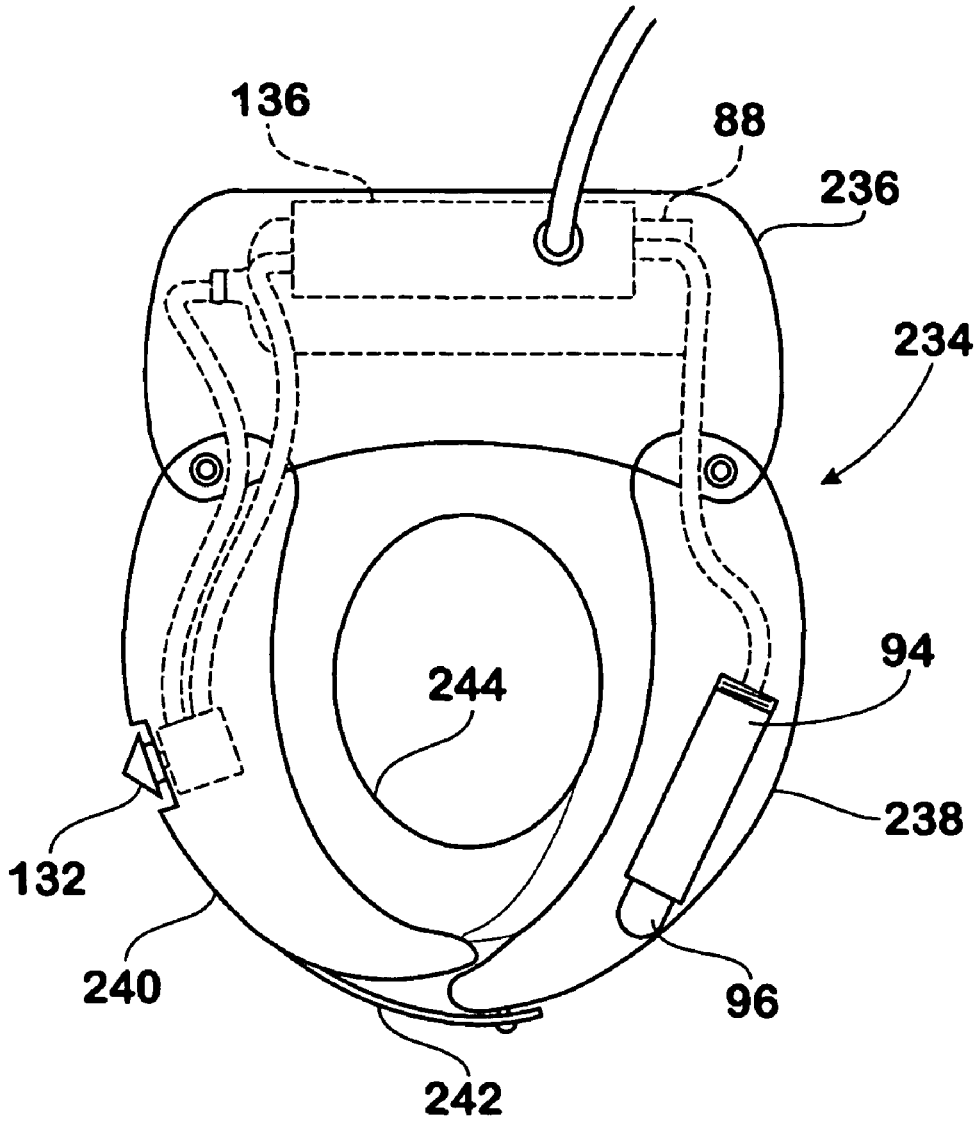
FIG. 32 shows a plan view of part of the diving apparatus of FIG. 31.

The connecting valve assembly 94 and the quick coupler 96 are mounted on the first engagement arm 238 as shown in FIG. 32. The manually operable valve 132 is mounted on the second engagement arm 240, also as shown in FIG. 32.

A releasable fastener 242 is attached to a free end of the second engagement arm 240 and is releasably fastenable to the free end of the first engagement arm 238 to secure the arms 238, 240 together about the diver's neck.

Figure 33:
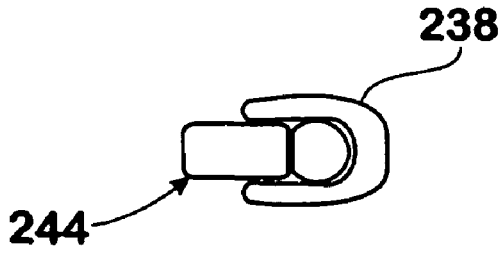
FIG. 33 shows a detailed view of a structure of the part of FIG. 32.

The arms 238, 240 are of rubber. An insert 244 of a resiliently flexible material such as a gel-like material is mounted in each of the arms 238, 240 as shown in FIG. 33. The insert 244 is configured to provide a level of comfort to the diver.

Figure 34:
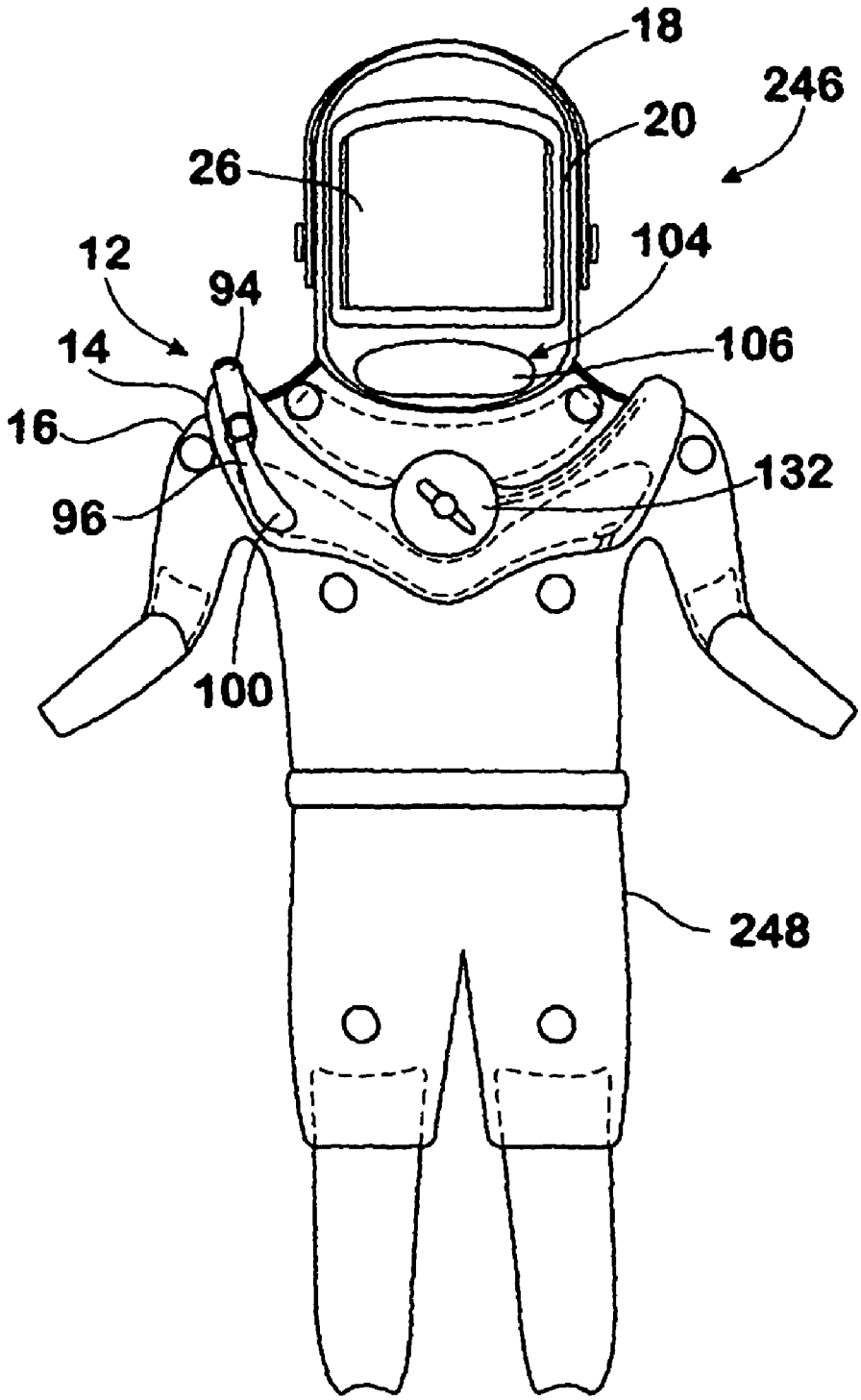
FIG. 34 shows a seventh embodiment of a diving apparatus, in accordance with the invention.

In FIG. 34, reference numeral 246 generally indicates a seventh embodiment of a diving apparatus, in accordance with the invention. With reference to FIGS. 1 to 33, like reference numerals refer to like parts, unless otherwise specified.

The apparatus 246 includes what is referred to as a dry suit, indicated at 248. The dry suit 248 is connected to the shoulder harness 12. The dry suit 248 is connected, in a watertight manner, to the collar 70.

Figure 35:
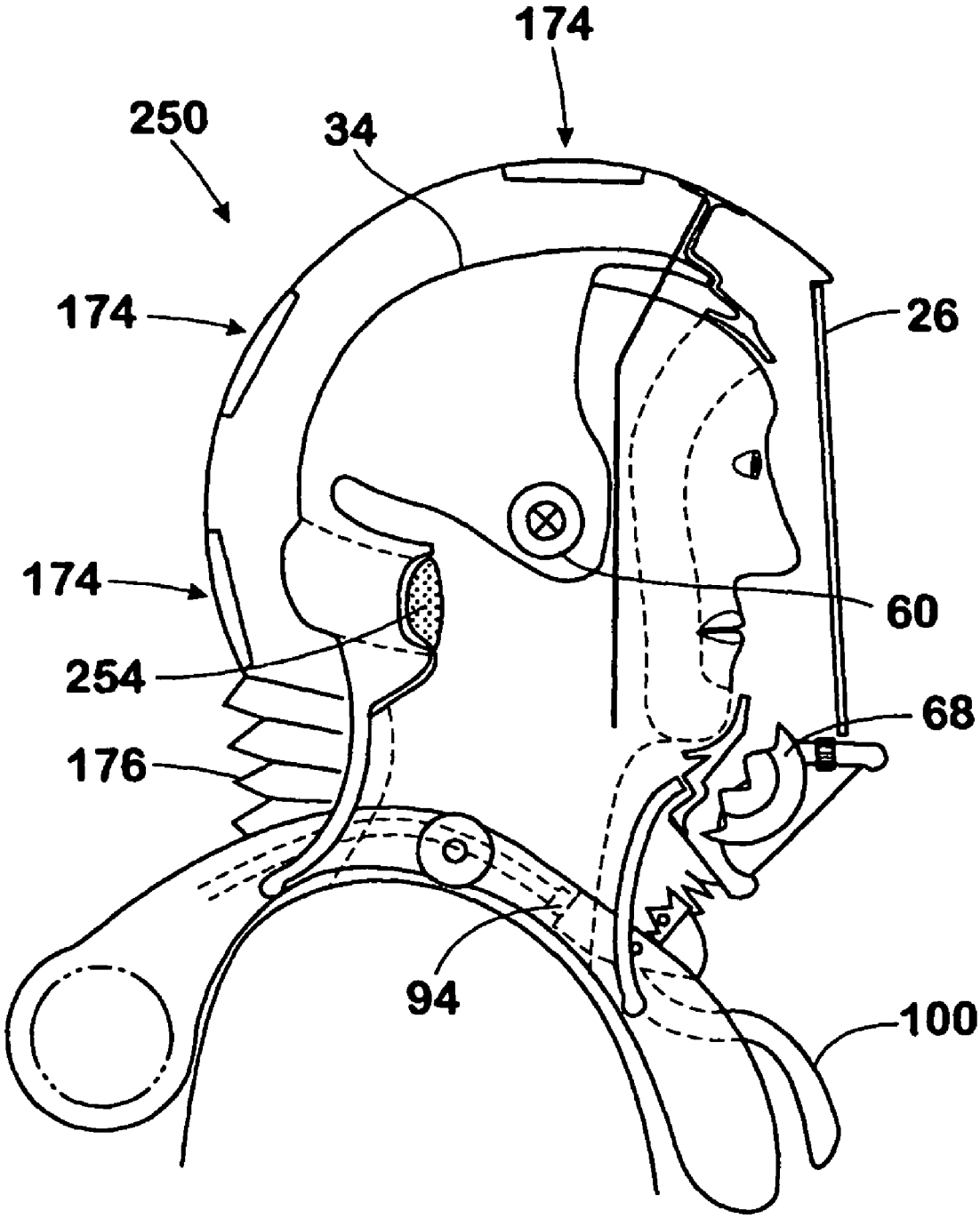
FIG. 35 shows a partially sectioned side view of an eighth embodiment of a diving apparatus, in accordance with the invention.
Figure 36:
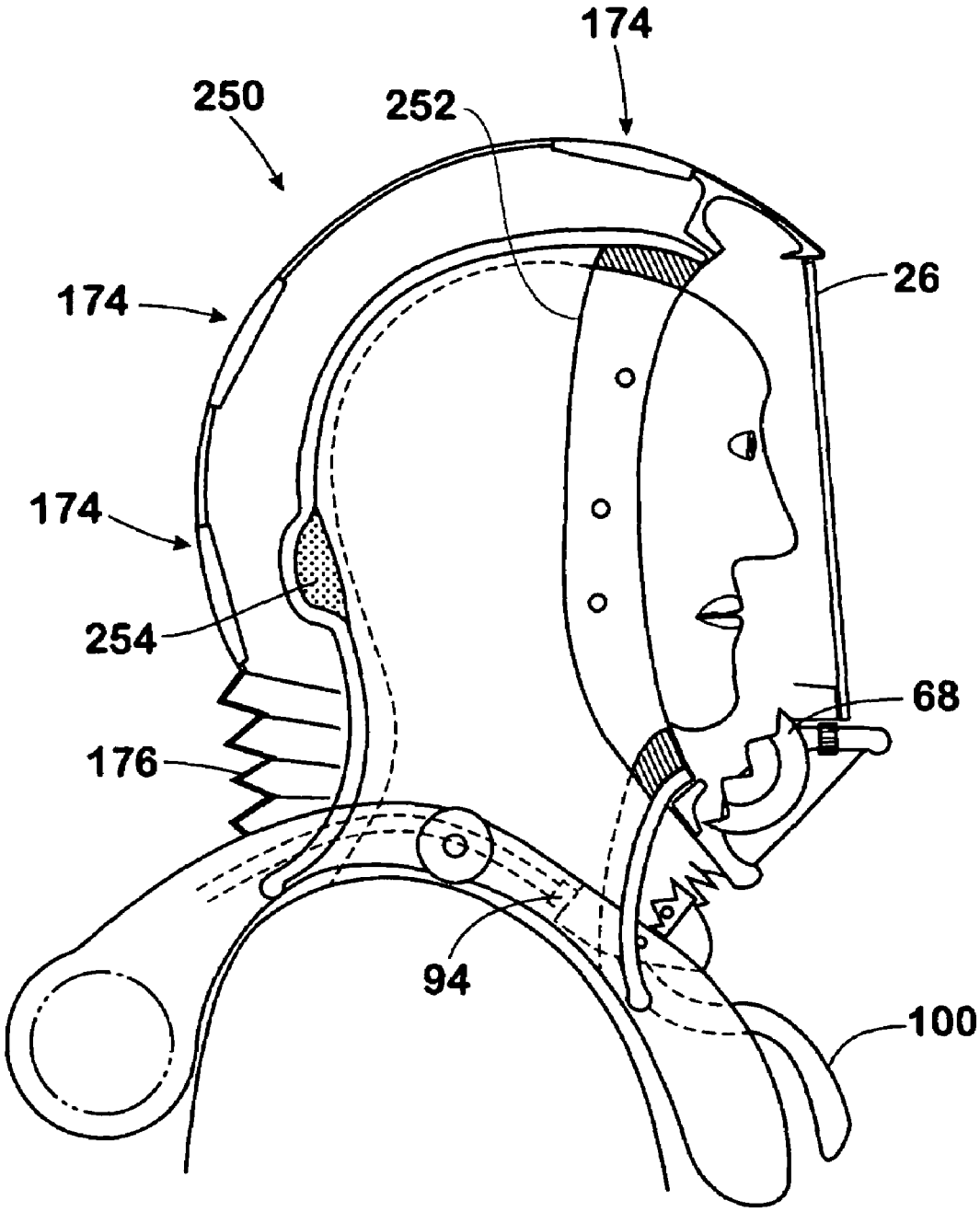
FIG. 36 shows a further partially sectioned side view of the embodiment of FIG. 35.

In FIGS. 35 and 36, reference numeral 250 generally indicates an eighth embodiment of a diving apparatus, in accordance with the invention. With reference to FIGS. 1 to 34, like reference numerals refer to like parts, unless otherwise specified, The apparatus 250 includes a facial sealing member 252 that is positioned on an inner surface of the neoprene hood 34. The sealing member 252 is positioned beneath the top fastener 168.1 and its corresponding connector 172. Thus, when the fastener 168.1 is tightened, the sealing member 252 is urged into engagement with the diver's head to ensure that water is kept out of the breathing air space 30.

The apparatus 250 also includes an anterior sealing member 254 that is positioned on the inner surface of the neoprene hood 34. The sealing member 254 is positioned beneath the bottom fastener 168.2 and its corresponding connector 172. Thus, when the fastener 168.2 is tightened, the sealing member 254 is urged into engagement with the diver's head to define a watertight bulkhead between the facial sealing member 252 and the anterior sealing member 254.

Figure 37:
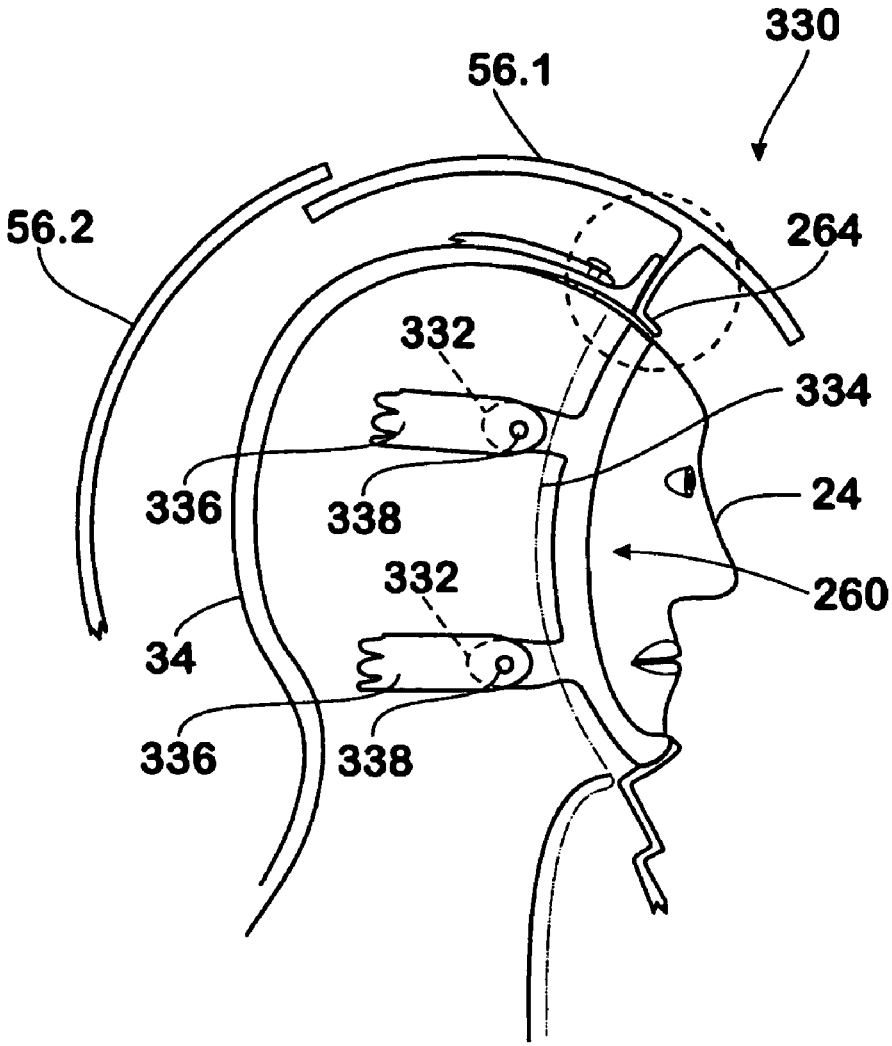
FIG. 37 shows a schematic side view of a ninth embodiment of the diving apparatus, in accordance with the invention.
Figure 37A:
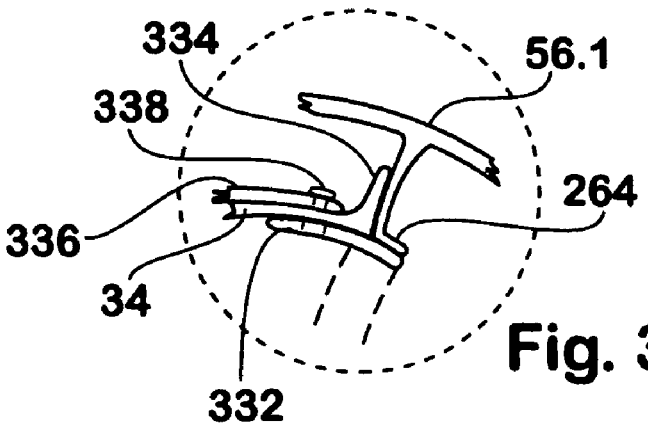
FIG. 37A shows a detailed view of part of the apparatus of FIG. 37.
Figure 37B:
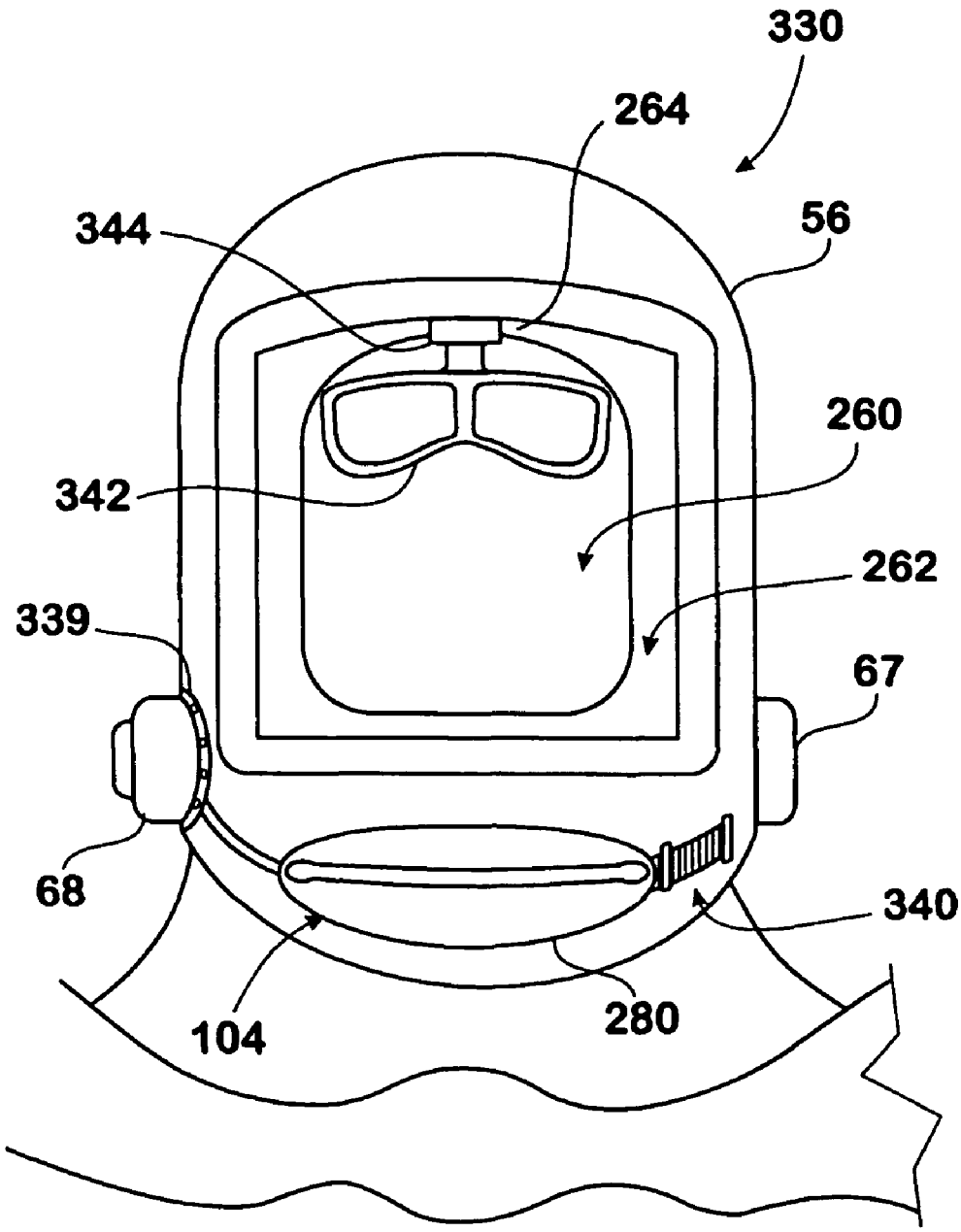
FIG. 37B shows a schematic front view of the apparatus of FIG. 37.

In FIGS. 37 and 37B, reference numeral 330 generally indicates a ninth embodiment of a diving apparatus, in accordance with the invention. With reference to FIGS. 1 to 36, like reference numerals refer to like parts, unless otherwise specified.

In this embodiment, the sealing member 28 has a number of tabs 332 extending rearwardly therefrom. A frontal portion 334 of the hood 34 is fast with the internal portion 264 of the helmet 18. The frontal portion 334 also overlies the tabs 332. Connectors 336 of a spider or the like are connected to the tabs 332 with fasteners 338 (FIG. 37A) that pass through the hood 34. Thus, the connectors 336 can be adjusted to urge the sealing member 28 against the diver's face 24.

In this embodiment, the regulator 68 is mounted on one side of the helmet 18, while the exhaust valve is mounted on an opposite side.

The regulator 68 is mounted on the helmet 18 with a bracket 339. As set out below, this bracket 339 is also used to connect an equalization assembly to the helmet. Also as described below, the equalization assembly includes a dipping arrangement 340 to permit the equalization assembly to be clipped onto or clipped off the helmet 18.

The apparatus 330 includes a pair of prescription goggles 342. The goggles 342 are mounted to the internal portion 264 of the helmet 18 with a suitable bracket Indicated at 344 to be positioned in front of the diver's eyes.

Figure 38:
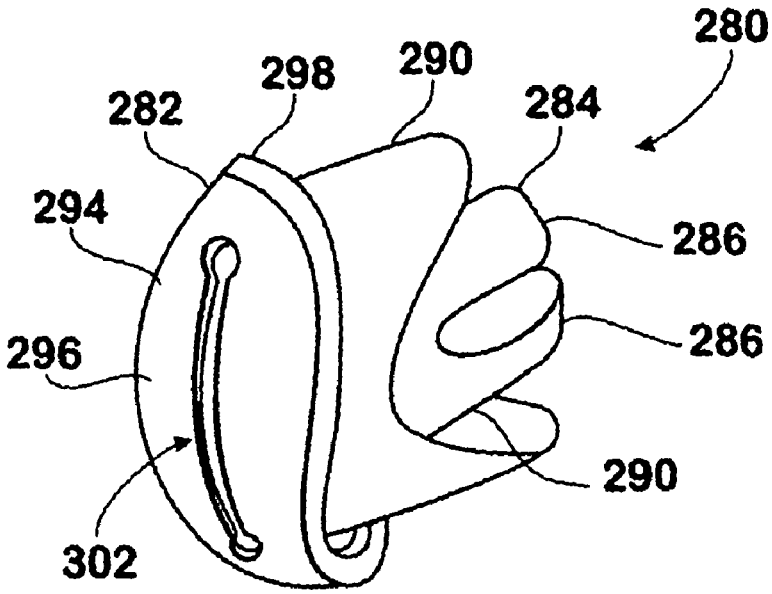
FIG. 38 shows a three dimensional view of one example of an equalization assembly for a diving apparatus of either of the embodiments of the diving apparatus of the invention.
Figure 39:
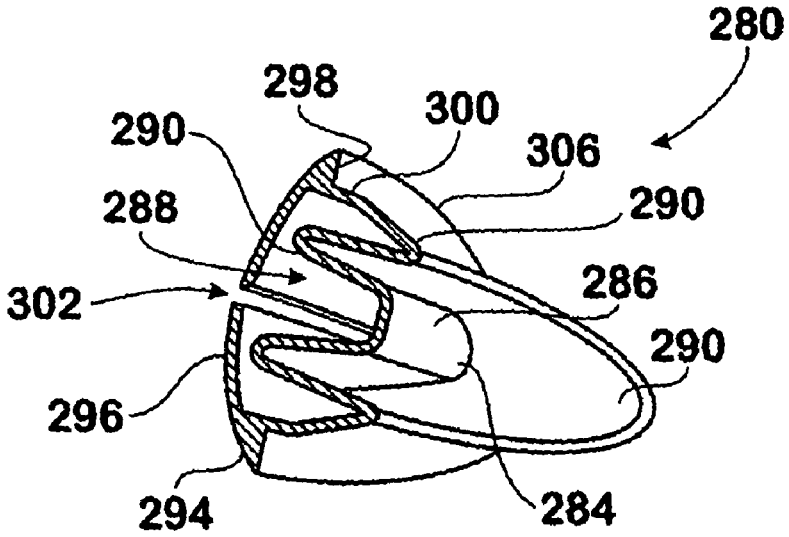
FIG. 39 shows a sectioned three-dimensional view of the equalization assembly of FIG. 38.
Figure 40:
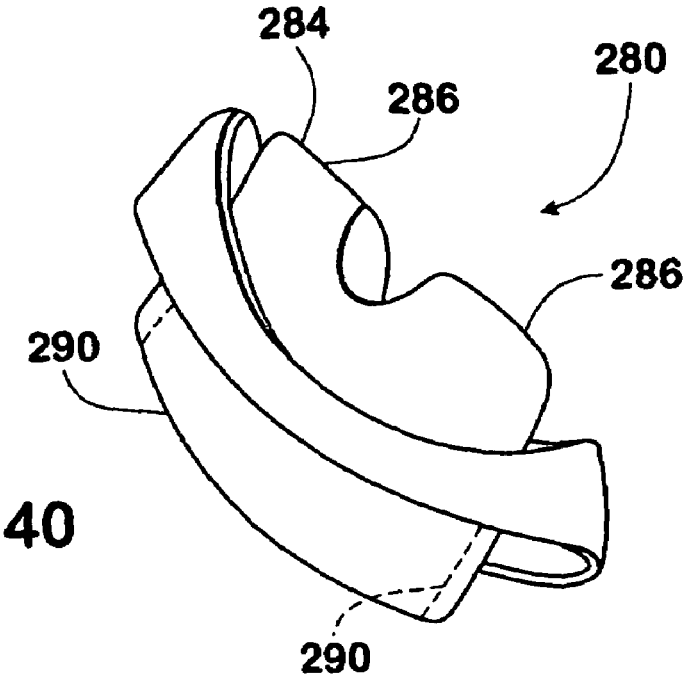
FIG. 40 shows a three-dimensional view of a base structure, a nose-engaging member and an extendible portion of the equalization assembly of FIG. 38.
Figure 41:
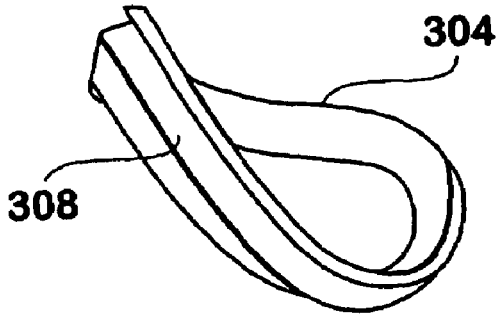
FIG. 41 shows a sealing gasket of the assembly of FIG. 38.
Figure 42:
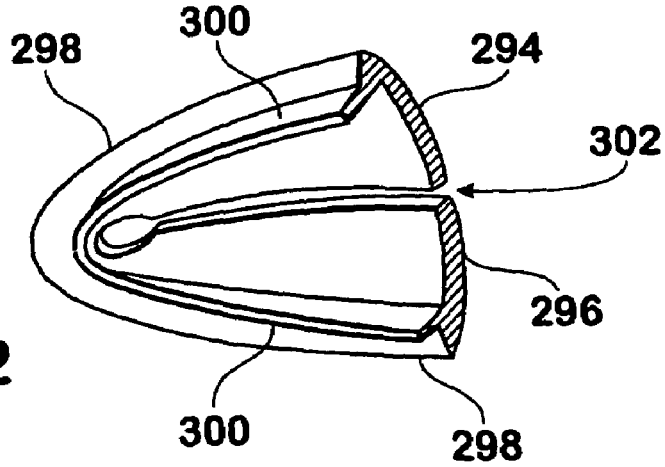
FIG. 42 shows a three-dimensional, internal view of a cover member of the assembly of FIG. 38.

In FIG. 38, reference numeral 280 generally indicates an equalisation assembly for use with a diving apparatus as described above.

The assembly 280 includes a base structure 282 that is engageable with an edge portion of the helmet 18 defining the equalization opening 104.

The assembly 280 further includes a nose-engaging member 284 that defines a volume in which a pair of digits can be received to manipulate the nose-engaging member 284. In particular, the nose-engaging member 284 is in the form of a pair of spaced gripping members 286. Each gripping member 286 defines a pocket 288 in which a restive digit is received. The gripping members 286 are spaced so that a diver's nose can be received between the gripping members 286 and the diver can use his or her digits to pinch his or her nostrils dosed with the gripping members 286.

The assembly 280 includes an extendible portion 290 that is interposed between the base structure 282 and the nose-engaging member 284. The extendible portion 290 is configured to permit the nose-engaging member 284 to be displaced away from the base structure 282 into an operative position in which the diver can pinch his or her nostrils closed and towards the base structure 282 into an inoperative position in which the nose-engaging member 284 is clear of the diver's nose.

Figure 43:
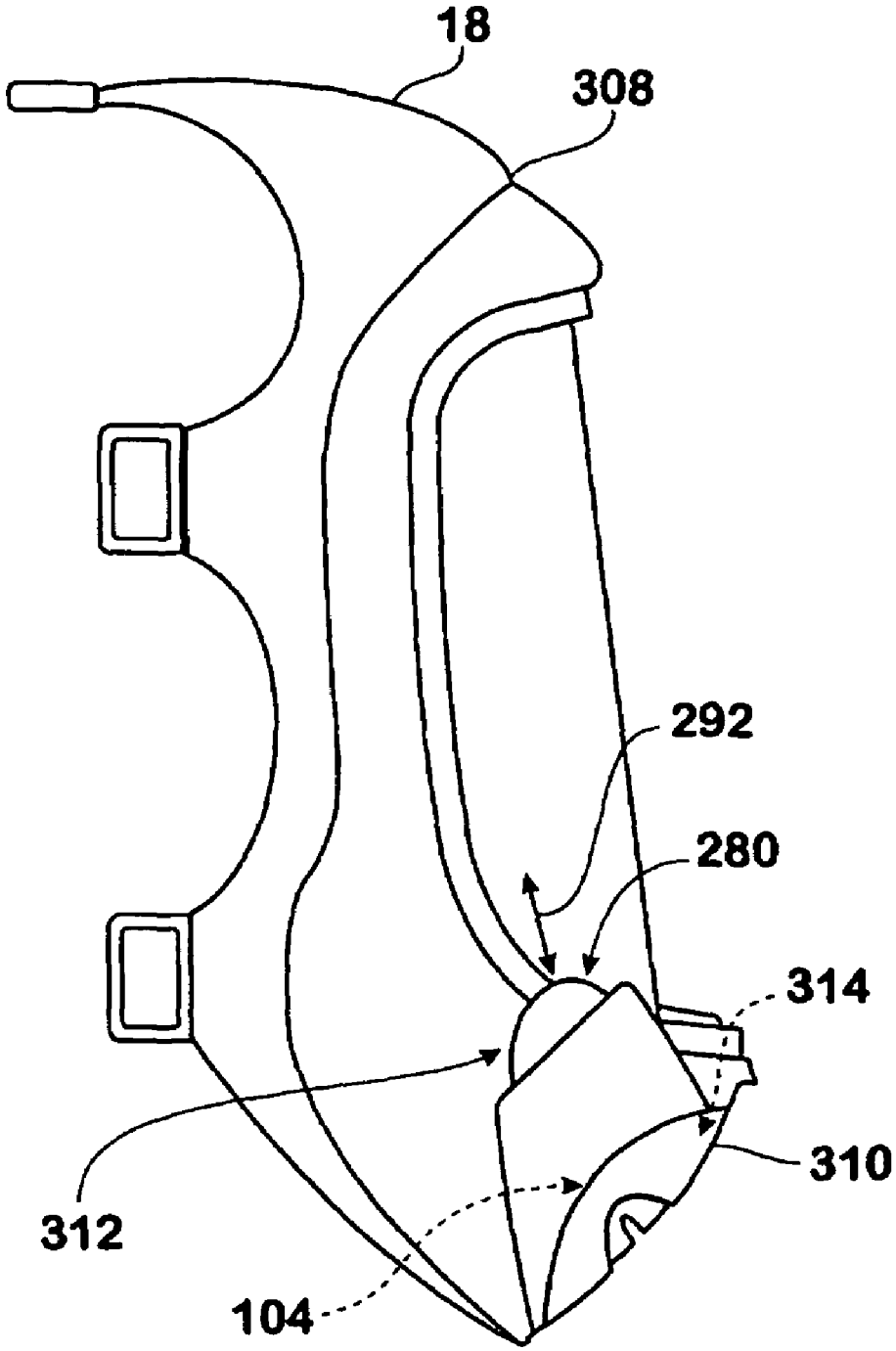
FIG. 43 shows a schematic side view of a diving apparatus, in accordance with the invention, incorporating the assembly of FIG. 38.
Figure 44:
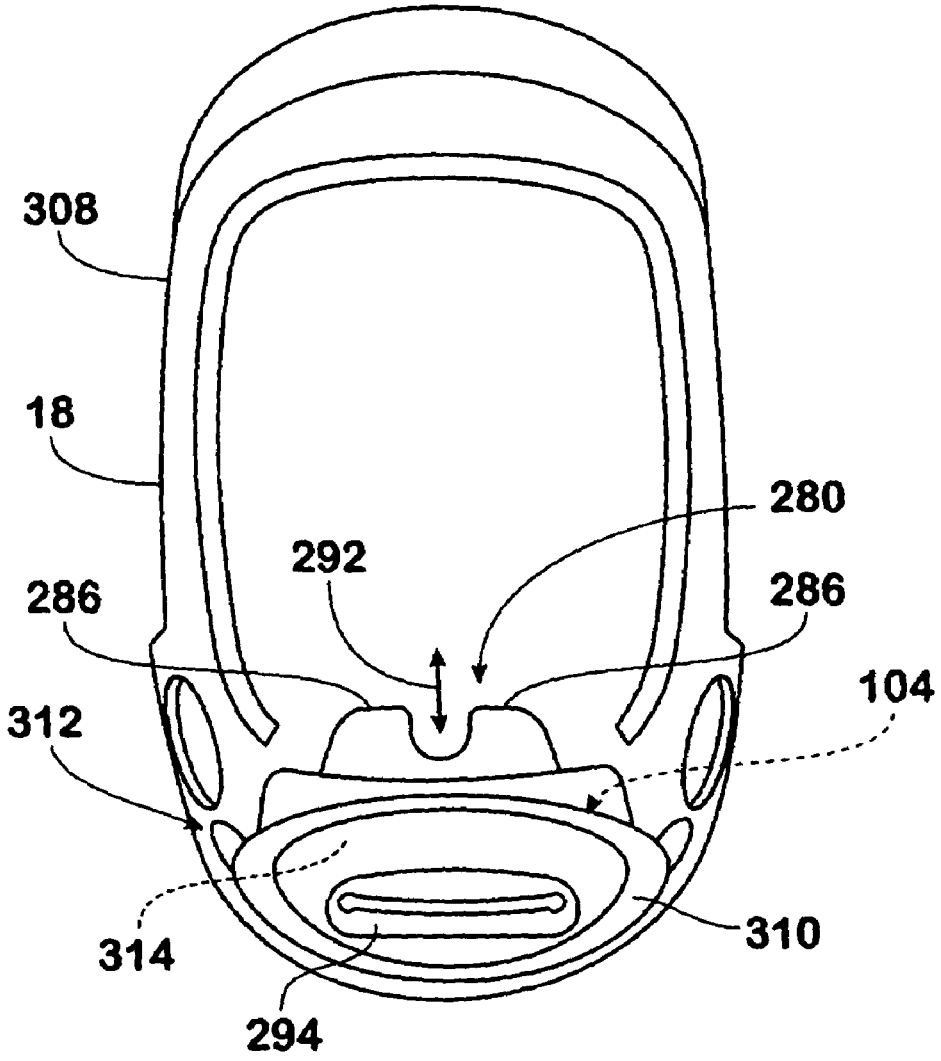
FIG. 44 shows a schematic front view of the diving apparatus of FIG. 43.

The extendible portion 290 is in the form of a tubular length of resiliently flexible material. The portion 290 is telescopically folded so that the portion 290 unfolds partially when the nose-engaging member 284 is displaced into its operative condition. In particular, the portion 290 is configured to be biased into its inoperative position so that, when the diver withdraws his or her fingers from the gripping formations 286, the nose-engaging member 284 retracts into its Inoperative position under action of a release of tension in the material of the portion 290. An arrow 292 indicates this movement of the nose-engaging member 284 as shown in FIGS. 43 and 44.

The nose-engaging member 284, the extendible portion 290 and the support structure 282 are of a unitary, one-piece molding of the resiliently flexible material. The resiliently flexible material can be an elastomeric material such as silicone or rubber.

The base structure 282 includes a cover member 294. The cover member 294 has a closure 296. A connecting formation is positioned on the cover member 294 to permit the cover member 294 and thus the assembly 280 to be connected to the helmet 18. The connecting formation includes a flange 298 positioned about a periphery of the closure 296. A skirt 300 depends from the flange 298 and is connected to the base structure 282.

The closure 296 of the cover member 294 defines a slotted opening 302. The cover member 294 is also of a resiliently flexible material such as an elastomer or rubber. Thus, the closure 296 can deform so that the slotted opening 302 can enlarge to accommodate the diver's hand.

The assembly 280 includes a sealing gasket 304. The sealing gasket 304 is Interposed between the flange 298 and said edge portion of the helmet 18 that defines the equalization opening 104. In order to achieve this, the sealing gasket 304 has a peripheral engaging formation 308 that engages the flange 298 and skirt 300 of the cover member 294. When connected to the helmet 18, the skirt 300 extends into the equalization opening 104.

Figure 45:
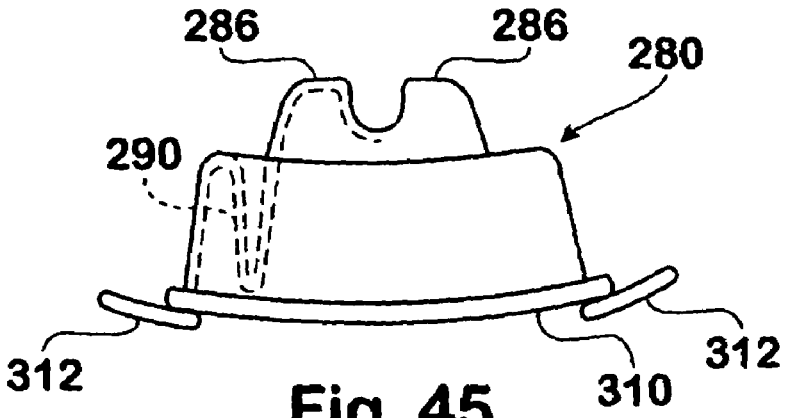
FIG. 45 shows a top plan view of the assembly of FIG. 38 as positioned in a diving apparatus.

In FIGS. 43 to 45, reference numeral 308 generally indicates a diving apparatus, in accordance with the invention, with the assembly 280 positioned in the equalization opening 104 of the helmet 18. With reference to FIGS. 38 to 42, like reference numerals refer to like parts, unless otherwise specified.

The apparatus 308 includes a clamping member 310 that is releasably connected to part of the helmet 18 with a connecting arrangement indicated at 312. The connecting arrangement 312 is configured so that, when the clamping member 310 is connected to said part of the helmet 18, the clamping member 310 serves to urge the cover member 294 and thus the sealing gasket 304 against an edge portion 314 of the helmet 18 that defines the equalization opening 104. This serves to seal the assembly 280 against the edge portion 314.

The connecting arrangement 312 is configured to be readily releasable so that the assembly 280 can be removed from the helmet 18. This may be necessary in the event of an emergency ascent.

Figure 46:
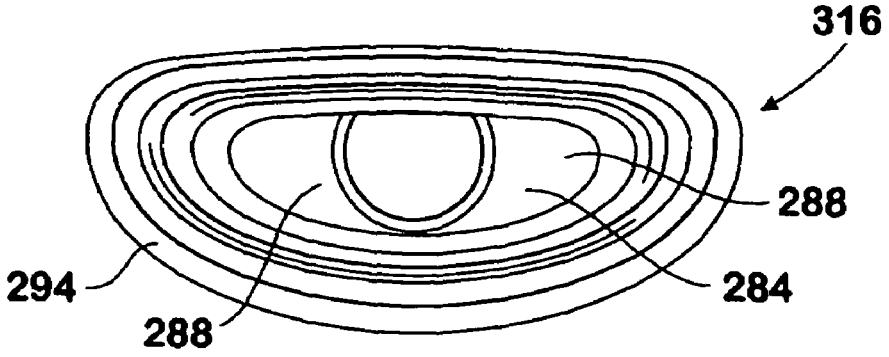
FIG. 46 shows a rear view of another example of an equalization assembly, in accordance with the invention.
Figure 47:
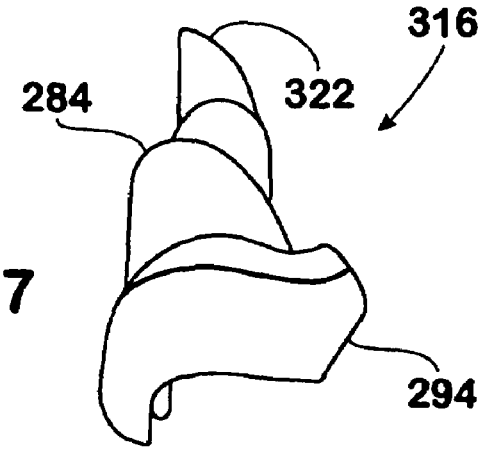
FIG. 47 shows a side view of the equalization assembly of FIG. 46.
Figure 48:
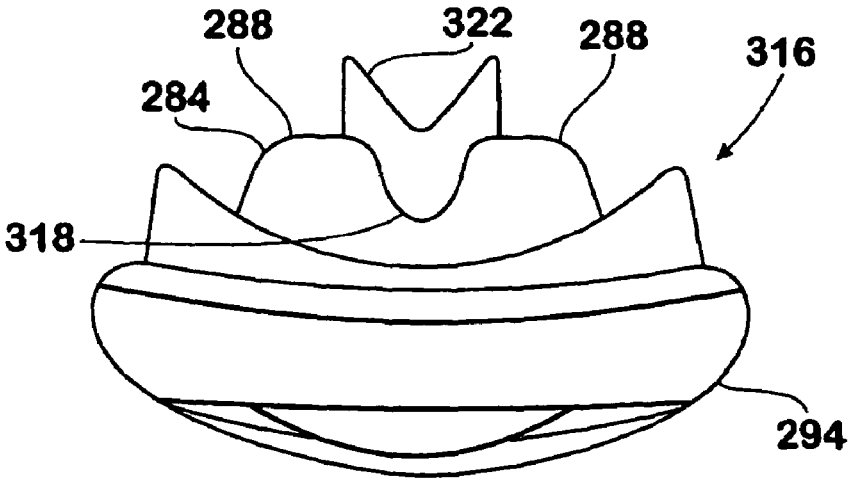
FIG. 48 shows a plan view of the equalization assembly of FIG. 46.
Figure 49:
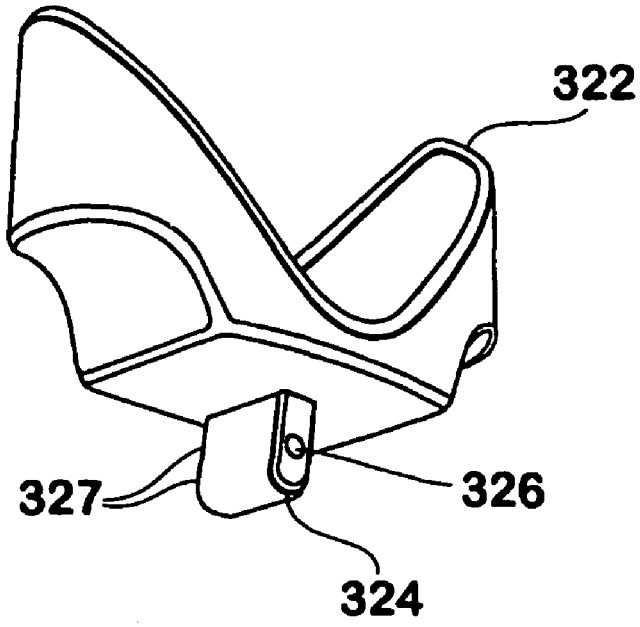
FIG. 49 shows a three-dimensional view of a nosepiece of the equalization assembly of FIG. 46.

In FIGS. 46 to 48, reference numeral 316 generally indicates another example of an equalization assembly that is suitable for use with a diving apparatus of the Invention. With reference to FIGS. 38 to 45, like reference numerals refer to like parts, unless otherwise specified.

Figure 50:
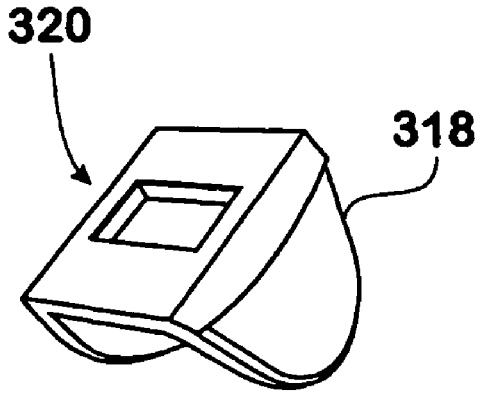
FIG. 50 shows a three-dimensional view of a mounting member for the nosepiece of FIG. 49.

The assembly 316 includes a mounting member 318 (shown in detail in FIG. 50) that is mountable on the nose-engaging member 284, between the spaced gripping members 286. In this example, the mounting member 318 is glued to the nose-engaging member. The mounting member 318 defines a socket 320 in an outer surface thereof.

The assembly 316 includes a nosepiece 322. The nosepiece 322 is shaped to correspond to an external profile of the diver's nostrils, so that, if the nosepiece 322 is urged into engagement with the diver's nose, the nosepiece 322 serves to block the diver's nose. A spigot 324 extends from a base of the nosepiece 22. The spigot 324 is dimensioned to be received in the socket 320. A number of ribs 327 are defined on the spigot 324 to retain the spigot 324 in position in the socket 324. Both the socket 320 and the spigot 324 are shaped so that the spigot 324 can only be received in the socket 320 when the nosepiece 322 is correctly oriented.

An opening 326 for a string or lanyard is defined in the spigot 324.

Both the spigot 324 and the socket 320 are dimensioned so that the nosepiece 322 can readily be replaced with a nosepiece belonging to a different diver.

In use, instead of having actually to pinch the nostrils closed as with the assembly 280, the diver can simply urge the nosepiece 322 towards his or her nose so that the nosepiece 322 serves to close the nostrils. Further, the fact that the nosepiece 322 is readily replaceable prevents the possible transfer of germs and bacteria when different divers use the diving apparatus.

With both assemblies 280, 316, the provision of the extendible portion 20 causes the nose-engaging member 14 to retract. Thus, equalization does not interfere with the visibility of a diver's face, an important consideration in recreational, tourist-based, diving.

Figure 51:
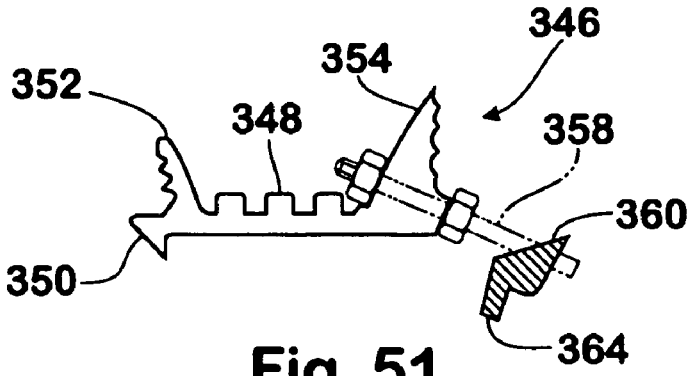
FIG. 51 shows a side view of one example of a dipping arrangement for the equalization assembly.
Figure 52:
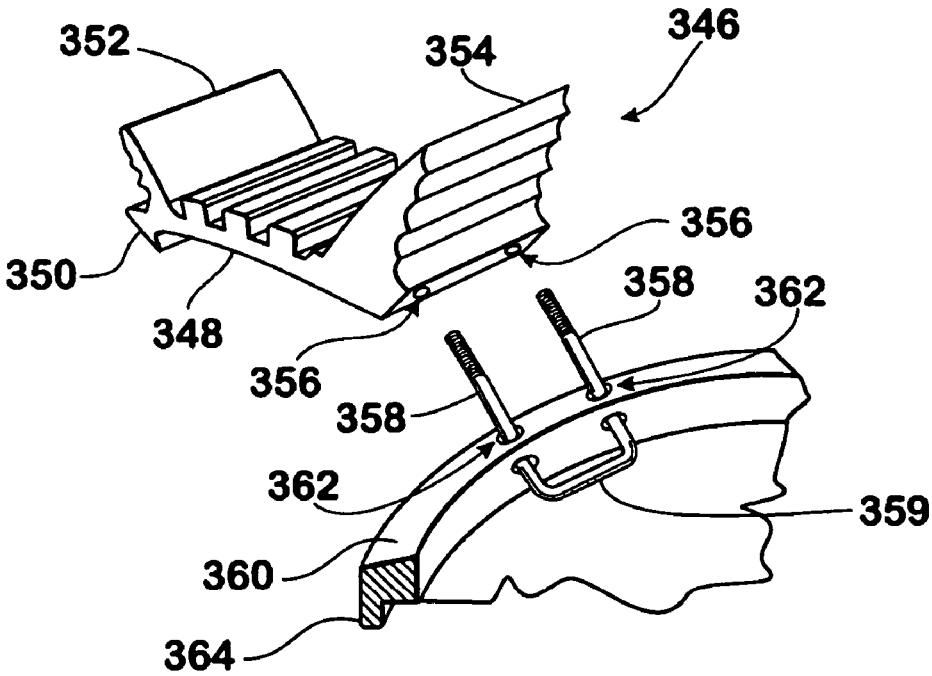
FIG. 52 shows a three dimensional view of the dipping arrangement of FIG. 51.

In FIGS. 51 and 52, reference numeral 346 indicates a dipping arrangement that is used selectively to fasten or release the equalization assembly 280, 316.

The clipping arrangement 346 includes a strap 348 which is capable of elastic extension. A free end 350 of the strap 348 has a hooking formation 350 that is shaped to engage a complementary hooking formation on the helmet 18. A gripping formation 352 extends from the strap 348 proximate the hooking formation 350 so that a diver can manipulate the hooking formation 350 into position. The gripping formation 352 is configured so that the hooking formation 350 can be released by simply twisting the gripping formation 352.

A mounting formation 354 is positioned on an opposite end of the strap 348. The mounting formation 354 has a pair of openings 356 defined therein. Legs 358 of a U-shaped connector 359 are received in the openings 356 to be fasted to the mounting formation 354.

The clamping member 310 has a raised peripheral formation 360 that has a pair of passages 362 extending therethrough. The legs 358 are also received through the passages 362. The peripheral formation 360 is shaped to define a sealing lip 364 that extends towards the helmet 18. The lip 364 and the passages 362 are positioned so that a force exerted by the strap 348 results in the lip 364 being urged against the helmet 18 to create a sealing effect.

Figure 54:
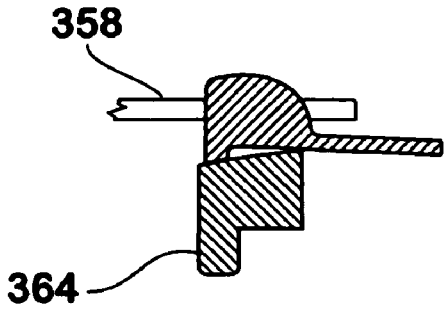
FIG. 54 shows a side view of a detail of the dipping arrangement of FIG. 53.
Figure 53:
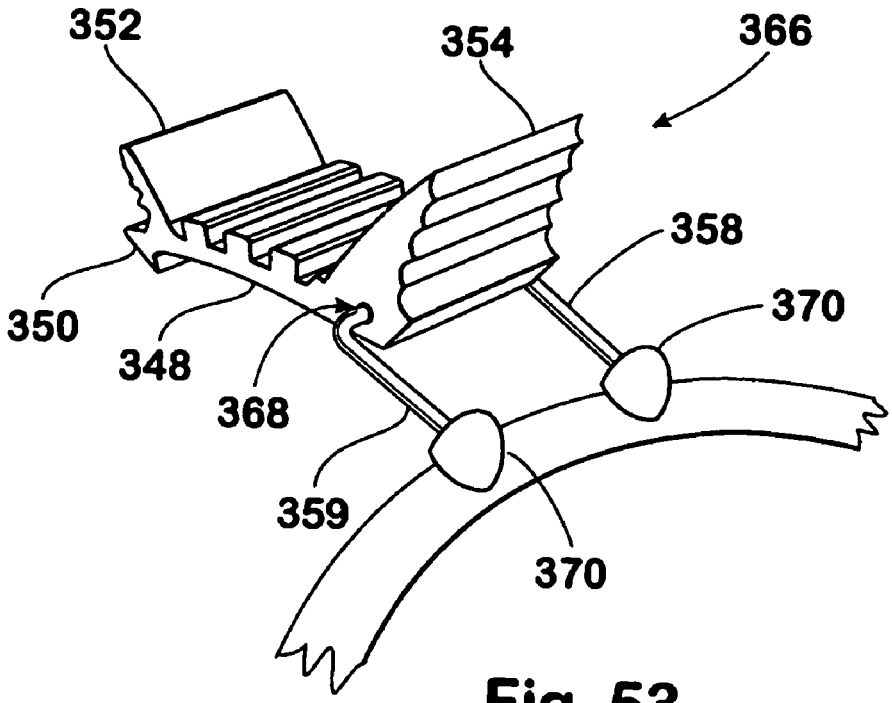
FIG. 53 shows a three-dimensional view of another example of a dipping arrangement for the equalization assembly.

In FIGS. 53 and 54, reference numeral 366 generally indicates another example of a dipping arrangement that is used selectively to fasten or release the equalization assembly 280, 316. With reference to FIGS. 51 and 52, like reference numerals refer to like parts, unless otherwise specified.

In this example, the mounting formation 354 has a passage 368 extending therethrough, to accommodate a base of the U-shaped connector 359. The peripheral formation 360 defines a pair of projections 370, each projection 370 having an opening to accommodate a respective leg 358 of the connector 359.

Figure 55:
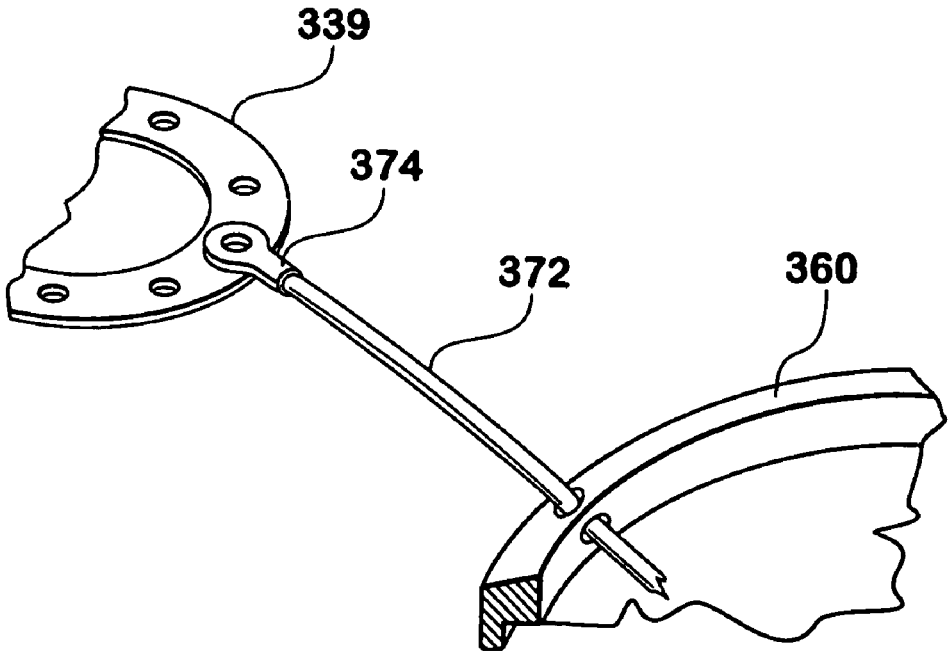
FIG. 55 shows a three-dimensional view of a connecting arrangement for the equalization assembly.
Figure 56:
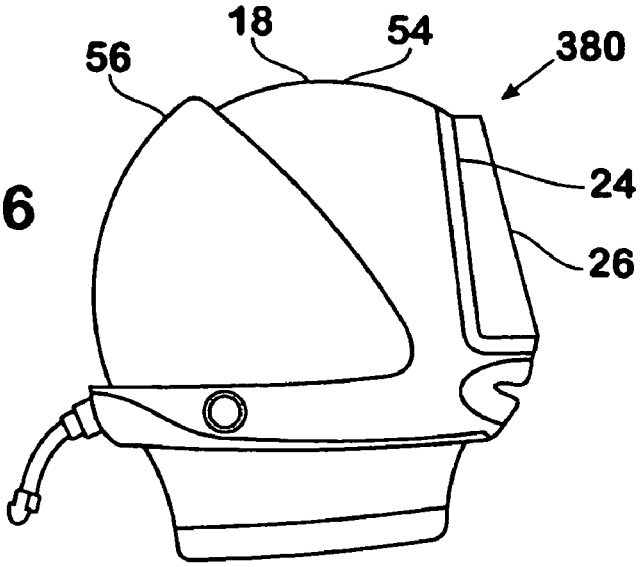
FIG. 56 shows a schematic side view of a tenth embodiment of a diving apparatus, in accordance with the invention.
Figure 57:
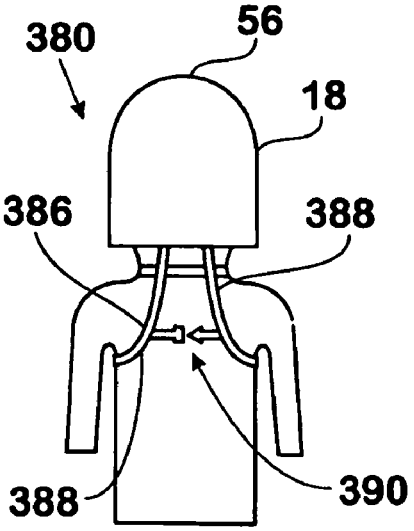
FIG. 57 shows a schematic front view of the apparatus of FIG. 56, in use.
Figure 59:
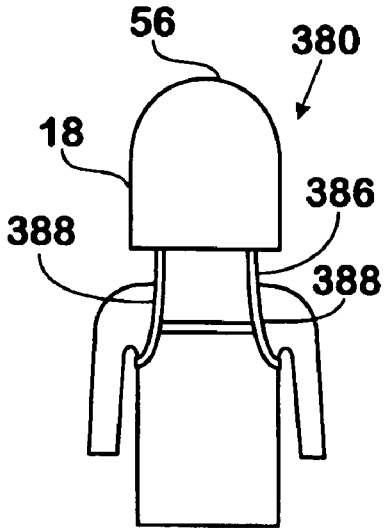
FIG. 59 shows a schematic rear view of the apparatus of FIG. 56, in use.
Figure 58:
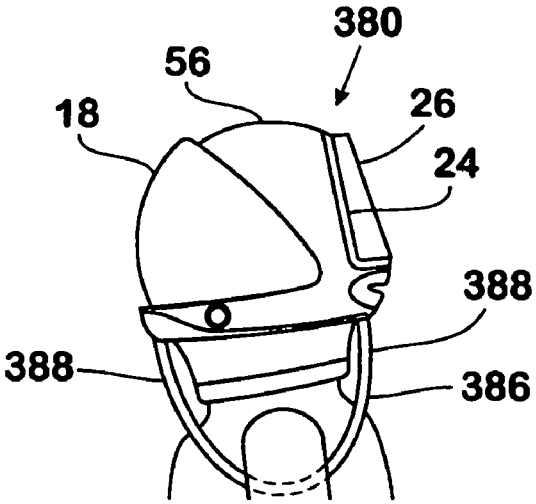
FIG. 58 shows a schematic side view of the apparatus of FIG. 56, in use.
Figure 60:
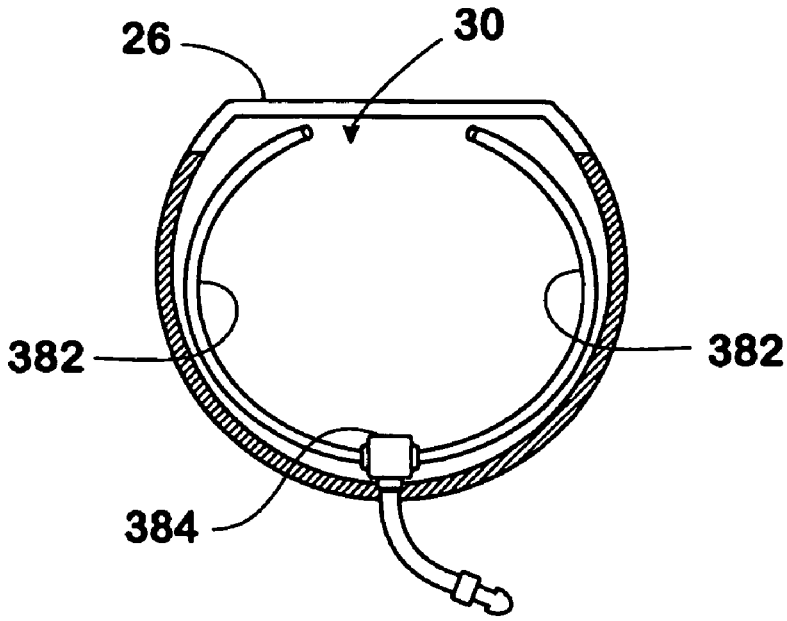
FIG. 60 shows a schematic sectioned plan view of the apparatus of FIG. 56.
Figure 61:
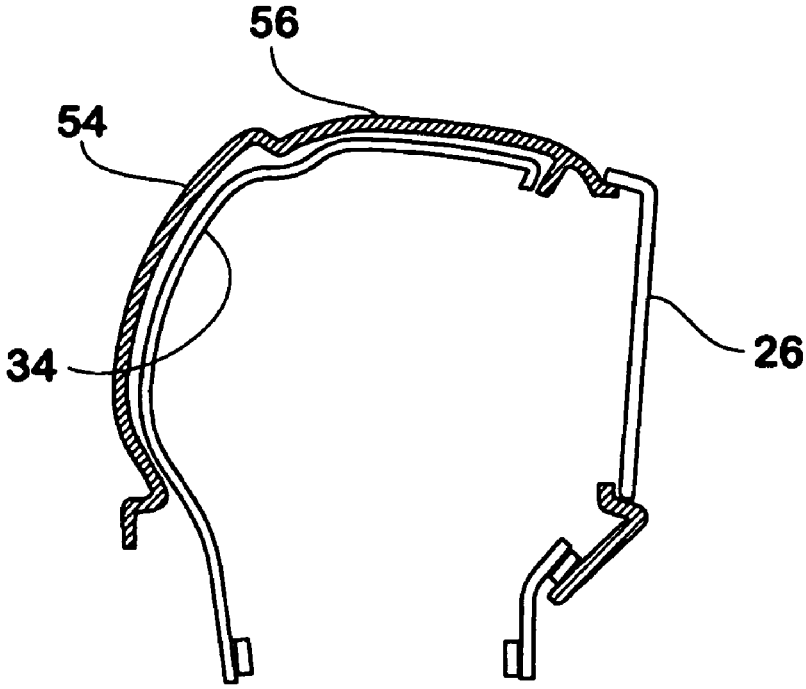
FIG. 61 shows a schematic sectioned side view of the apparatus of FIG. 56.

FIG. 55 illustrates how the clamping member 310 is connected to the helmet 18 opposite the clipping arrangement 340. A rod 372 is connected, at one end, to the bracket 339 that secures the regulator 68 to the helmet 18. Instead, the rod 372 can be connected to the helmet 18 with a purpose-built bracket. An opposite end of the rod 372 is fastened to the peripheral formation 360. The rod 372 is fast with the bracket 339 via a sleeved eyelet 374. The rod 372 is fast with the peripheral formation 360 via a conventional threaded nut. It follows that that end of the rod 372 that is engaged with the peripheral formation 360 has a right-handed thread. The sleeved eyelet 374 and the opposite end of the rod 372 have a left-handed thread. It follows that the tension in the rod 372 and thus the strap 348 can be adjusted by rotation of the rod 372.

In FIGS. 56 to 61, reference numeral 380 generally indicates a tenth embodiment of a diving apparatus, in accordance with the invention. With reference to FIGS. 1 to 55, like reference numerals refer to like parts, unless otherwise specified.

The apparatus 380 does not include a regulator. Instead, a pair of air pipes 382 extends into the breathing space 30 from a manifold 384. One of the air pipes 382 receives an air supply with conventional snorkelling, while the other has air pumped through it. This ensures that the pressure differential associated with conventional snorkelling can be overcome.

The apparatus 380 includes the exhaust valve 67 on the side of the helmet 18.

Further, the apparatus 380 includes a simple harness 386 that has a pair of straps 388. The straps 388 are retained in position with a quick release mechanism indicated at 390.

Applicant believes that this invention embodies a number of improvements over the prior art apparatus described in the background of this specification.

The position of the sealing member 28 is such that full facial visibility is achieved without the need for retaining a relatively large volume of air underwater. Instead, only the face, rather than the whole head is positioned in a watertight volume. This reduces buoyancy and it is thus not necessary to provide a large and heavy helmet structure, as is the case with the prior art. Instead, a simple weight belt can be used to keep the diver submerged. Thus, the apparatus of the invention serves to lower a centre of gravity of a diver, thereby avoiding the dangerous possibility of tipping over.

The fact that full facial visibility is achieved is also useful for the diver in that it allows the diver to have a clear view of his or her surroundings. Conventional diving masks do not provide such a feature. This increase in visibility has also been achieved through the positioning of the equalization assembly as shown in the drawings.

Furthermore, since the face is sealed with the apparatus of the invention, a diver can indeed be upside down without significant danger. As set out earlier, it is critical with the prior art recreational apparatus that the diver remains upright to ensure that air remains trapped in the helmet.

The fact that only the face is sealed off means that it is only necessary to maintain a relatively small volume of air about the face. This allows the provision of a small and unobtrusive emergency tank. Applicant has discovered that such a tank would not be able to supply a prior art helmet with an effective amount of air. The reason for this is simply that the prior art helmet defines a volume which is relatively large. This is one of the reasons why the prior art helmet has not found favour with any of the dive certification organizations.

It will readily be appreciated that where the nose- and mouthpiece 182 is provided, an even smaller breathing air space is defined. This allows the provision of an even smaller emergency tank, for example in the apparatus 232.

The apparatus of the invention does not require the high volume output compressor that is required by the prior art apparatus. The reason for this is again the fact that only the facial area is sealed off. This results in a substantial cost saving.

The provision of the emergency tank 88 and the quick coupler 96 permits a much greater degree of flexibility and safety underwater. The safety advantages are self-evident. However, with the present invention, it is possible for divers to move from walking about to an underwater craft that contains its own air supply. Thus, the divers can be led to the underwater craft, unhooked from the hooker hose 98 and hooked onto air hoses of the underwater craft. In this case, operation of the shuttle valve 78, as described above, ensures that the divers would not discern a loss of air as the hoses were changed. This allows for a substantially more enjoyable underwater experience.

Figure 13:
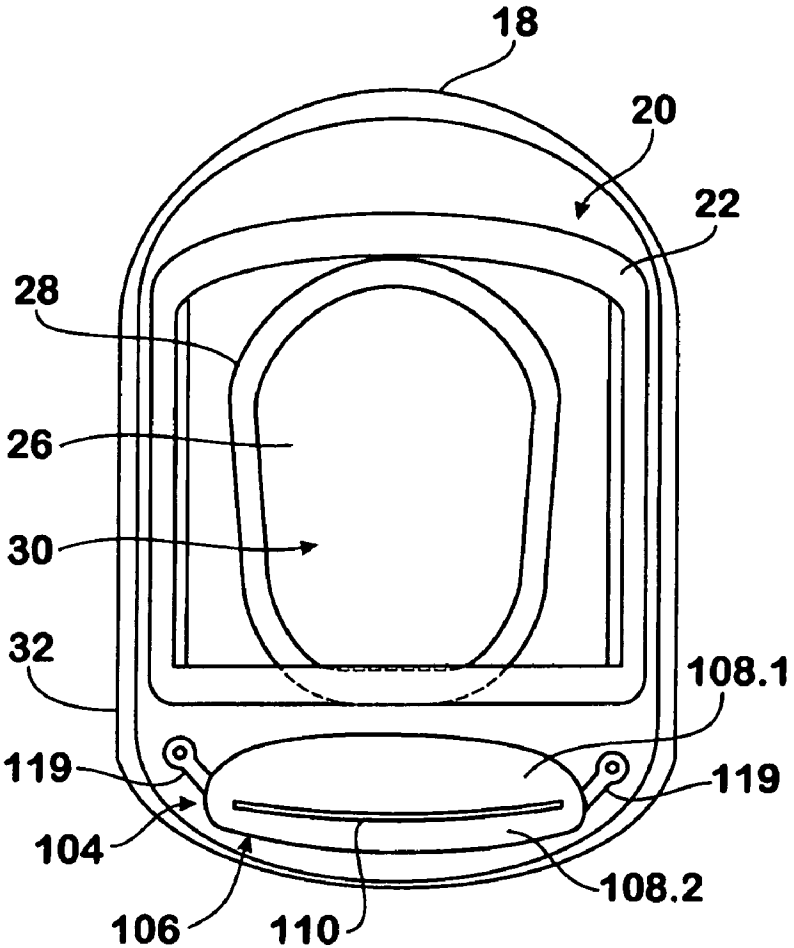
FIG. 13 shows a front view of part of the diving apparatus of FIG. 1, indicating a closure assembly for an equalization opening.
Figure 15:
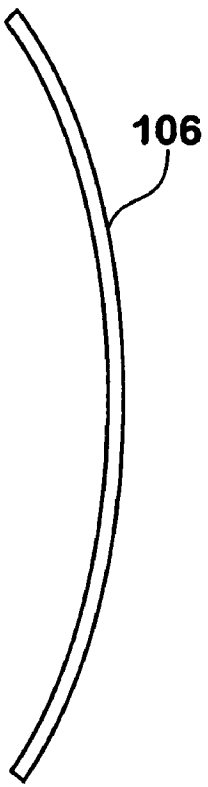
FIG. 15 shows a side view of the component of FIG. 14.
Figure 14:
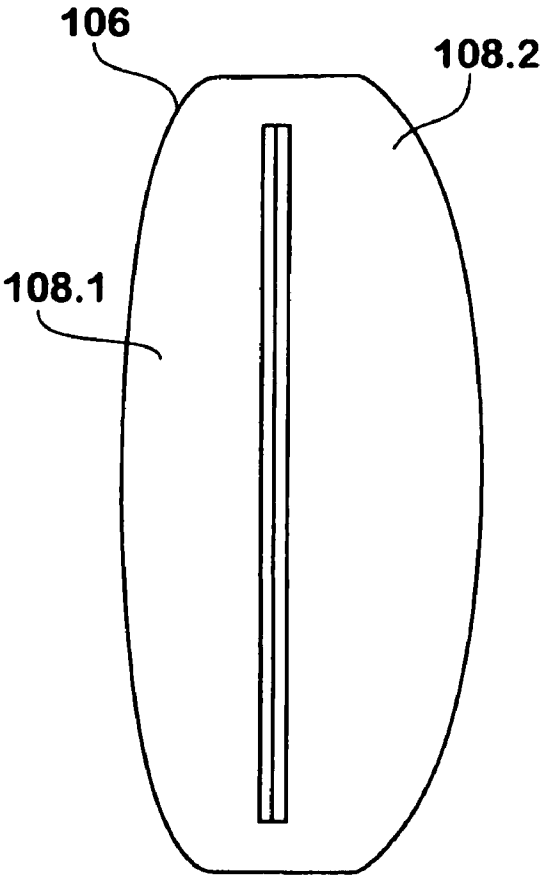
FIG. 14 shows a front view of a component of the closure assembly.
Figure 16:
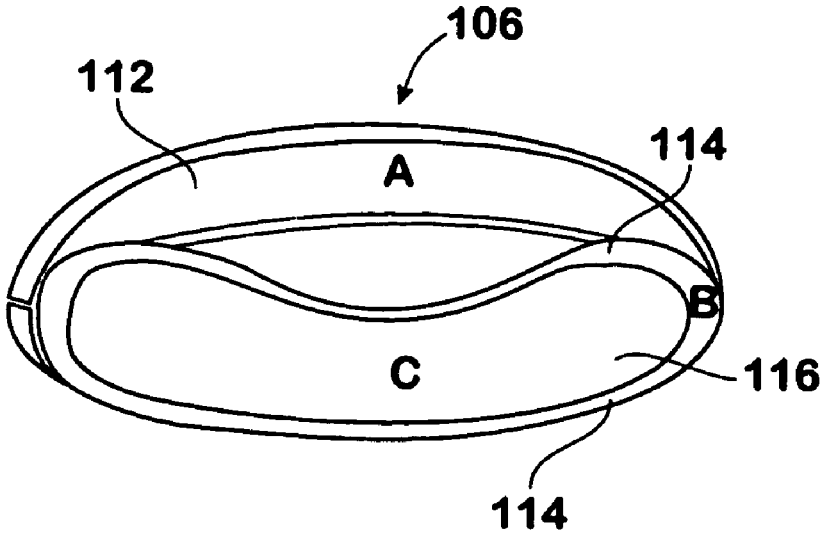
FIG. 16 shows a front view of the closure assembly of FIG. 13.
Figure 17:
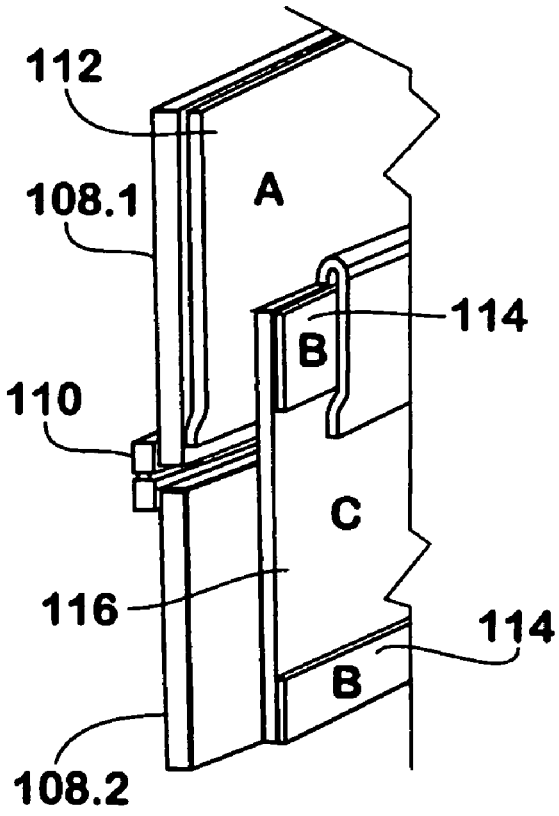
FIG. 17 shows a detailed view of part of the closure assembly of FIG. 13.

A major safety issue with the prior art apparatus is the fact that a diver cannot reach the surface in case of an emergency. This is another reason why the various certification bodies have not endorsed the prior art apparatus. With the present invention, reaching the surface can simply be achieved by releasing the weight belt and swimming up. At the surface, the air bladders 72, 126 provide flotation for the diver. The closure assembly 106 can be configured to be torn away from the base member 32 to permit fresh air to enter the air space 30. For example, as shown in FIG. 13, the closure assembly 106 can include tabs 119 that are designed to be unclipped from the base member 32 when the closure assembly 106 is removed from the base member 32.

Applicant respectfully submits that there are no reasons why the apparatus of the Invention should not be endorsed by such certification bodies.

A further advantage of the present invention is that the rigid support member 14 can have adjustable shoulder straps fitted. Thus, the apparatus is adjustable to suit different divers when it is fitted. This provides a high level of comfort.

Still further, the provision of the removable equalization assembly allows a diver to easily detach that assembly in an emergency. The assembly can also be removed during instruction and general communication when the diver is out of the water.

In conclusion, therefore, Applicant submits that the present invention provides a diving apparatus that is particularly suited for the tourist industry and yet complies with the safety expectations of commercial and SCUBA diving.

The invention claimed is:

1. A diving apparatus comprising;

a support structure that is engageable with a diver's head;

a lens that is mounted on the support structure, the lens and the support structure defining a breathing space from which the diver can be supplied with air;

a sealing arrangement positioned on the support structure to sealingly engage the diver's face so that the breathing space is substantially airtight;

an equalization assembly that is mounted on the support structure, the equalization assembly including an access means in the form of a nose-engaging member that is displaceable with respect to the support structure between an inoperative position in which the nose-engaging member is free of a diver's nose and an operative position in which the nose-engaging member can be used to block the diver's nostrils so that the diver can carry out an equalization procedure, the equalization assembly further including a pocket-shaped, flexible membrane that has an open end that is fastened to the support structure at an equalization opening and a closed end that defines the nose-engaging member, the membrane being dimensioned to accommodate the ingress of at least a diver's thumb and forefinger into the breathing space;

a gas supply arrangement that is in fluid communication with the breathing space to supply the breathing space with gas, the gas supply arrangement includes a regulator that is in fluid communication with the breathing space;

a connecting valve assembly, the connecting valve assembly having an inlet and an outlet, a primary air source being connectable to the inlet;

a safety valve assembly that has a primary inlet that is connected to the outlet of the connecting valve assembly, a second inlet and a primary outlet, the primary outlet being connected to the regulator;

a back-up, self-contained air supply having an outlet valve assembly that is connected to the secondary inlet of the safety valve assembly;

a control means arranged on the safety valve assembly to permit the safety valve assembly to direct air flow from the back up air supply instead of the primary air source, when necessary; and, a hood and a fastening structure that is positioned over the hood and that is engageable with the support structure, the support structure being shaped to carry the sealing arrangement so that, in use, the sealing arrangement is interposed between the diver's face and a portion of the support structure, the fastening structure being adjustable so that the portion of the support structure can be moved towards and away from the diver's face, wherein the support structure includes a base member to which a collar member is attached, and an adjustable cover assembly that is mounted on the base member, the cover assembly being adjustable between an operative position in which it covers the fastening structure and an inoperative position in which it allows access to the fastening structure.

2. A diving apparatus as claimed in claim 1, in which the equalization assembly includes a base structure that is sealingly engageable with an edge portion of the support structure defining the equalization opening and an extendible portion interposed between the nose-engaging member and the base structure, the extendible portion defining a volume in which at least two digits of the diver can be received so that the extendible portion can be urged toward the divers s nose into the operative position and retracted from the diver's nose into the inoperative position.

3. A diving apparatus as claimed in claim 2, in which the nose-engaging member includes a pair of sockets, each socket being shaped to receive a digit, with the sockets being spaced so that the diver's nose can be received between the sockets when the nose-engaging member is displaced into the operative position.

4. A diving apparatus as claimed in claim 3, in which a nosepiece is mounted on the sockets, the nosepiece being configured so that, as the nose-engaging member is urged into contact with the diver's nose, the nosepiece serves to close the diver's nostrils.

5. A diving apparatus as claimed in claim 1, which includes a shoulder harness, the support structure being connected to the shoulder harness with a flexible collar member that is interposed between the shoulder harness and the helmet and the back-up air supply being in the form of a breathing tank that is mounted on the shoulder harness.

6. A diving apparatus as claimed in claim 5, in which the flexible collar member includes an inflatable bladder, an inflating mechanism being mounted on the inflatable bladder to permit a diver to inflate the bladder and thus adjust a fit of the collar member.

7. A diving apparatus as claimed in claim 1, in which the safety valve assembly includes a secondary outlet that is connected to the inflating mechanism with a suitable conduit so that air from said air source can be used to inflate the bladder.

8. A diving apparatus as claimed in claim 1, in which a regulator is mounted on the base member to be in fluid communication with the breathing space.

9. A diving apparatus as claimed in claim 1, in which a base structure of the equalization assembly is detachably mounted on the base member so that the equalization assembly can be detached from the base member to provide access to the breathing space.

10. A diving apparatus as claimed in claim 9, in which the base structure is pivotally mounted on the base member to be pivotal between an open position in which the equalization assembly is detached from the base member and a closed position in which the base structure is sealingly engaged with the base member.

11. A diving apparatus as claimed in claim 10, in which a quick release clipping assembly is arranged on the base structure and the base member, to permit the base structure to be clipped onto or off the base member.

* * * * *